US011050201B2

(12) United States Patent
Chin

(10) Patent No.: US 11,050,201 B2
(45) Date of Patent: Jun. 29, 2021

(54) REPLACEABLE SOCKET DEVICE

(71) Applicant: Energy Full Electronics Co., Ltd, New Taipei (TW)

(72) Inventor: Hsu Shen Chin, New Taipei (TW)

(73) Assignee: Energy Full Electronics Co., Ltd, New Taipei (TW)

( * ) Notice: Subject to any disclaimer, the term of this patent is extended or adjusted under 35 U.S.C. 154(b) by 15 days.

(21) Appl. No.: 16/706,899

(22) Filed: Dec. 9, 2019

(65) Prior Publication Data

US 2020/0112132 A1 Apr. 9, 2020

Related U.S. Application Data

(63) Continuation of application No. 15/649,100, filed on Jul. 13, 2017, now Pat. No. 10,741,984.

(60) Provisional application No. 62/409,135, filed on Oct. 17, 2016.

(51) Int. Cl.

| | |
|---|---|
| ***H01R 13/44*** | (2006.01) |
| ***H01R 29/00*** | (2006.01) |
| ***H01R 13/24*** | (2006.01) |
| ***H01R 25/00*** | (2006.01) |
| ***H01R 13/62*** | (2006.01) |
| ***H01R 13/717*** | (2006.01) |
| ***H01R 25/16*** | (2006.01) |
| *H01R 24/64* | (2011.01) |
| *H01R 13/70* | (2006.01) |
| *H01R 31/06* | (2006.01) |
| *H01R 13/514* | (2006.01) |

(52) U.S. Cl.

CPC ..... *H01R 25/003* (2013.01); *H01R 13/6205* (2013.01); *H01R 13/7175* (2013.01); *H01R 25/162* (2013.01); *H01R 13/2421* (2013.01); *H01R 13/514* (2013.01); *H01R 13/70* (2013.01); *H01R 24/64* (2013.01); *H01R 31/065* (2013.01)

(58) Field of Classification Search

CPC .... H01R 25/142; H01R 31/06; H01R 23/025; H01R 33/92; H01R 23/6846; H01R 31/02

USPC ..... 439/145, 171, 518, 700

See application file for complete search history.

(56) References Cited

U.S. PATENT DOCUMENTS 4,545,632 A * 10/1985 Maier ..... H01R 25/00 439/148
5,919,060 A * 7/1999 Lee ..... H01R 27/00 439/518
6,602,081 B1 * 8/2003 Wang ..... H01R 13/4534 439/137

(Continued)

*Primary Examiner* — Abdullah A Riyami
*Assistant Examiner* — Thang H Nguyen

(57) ABSTRACT

A replaceable socket device includes one or more adapters, and an adapting interface. The adapter includes a jack and multiple contacts. The jacks are disposed on a top of the adapter for transmitting power or a network signal to an external device. The contacts are disposed on a bottom of the adapter. The adapter couples to external power via the contacts. The base includes a cable interface and one or more sockets. The cable interface connects to external power via a power cable and the one or more sockets is utilized to fix the one or more adapters. The adapting interface is utilized to connect the socket and the one or more adapters. The structure of the adapting interface corresponds to the contacts, for allowing the one or more adapters to couple to the one or more sockets via the adapting interface.

20 Claims, 19 Drawing Sheets

(56) References Cited

U.S. PATENT DOCUMENTS 7,264,492 B2 * 9/2007 Liang ..... H01R 13/22 439/151
7,563,144 B2 * 7/2009 Kunioka ..... G01R 1/0433 439/700
7,874,856 B1 * 1/2011 Schriefer ..... H01R 13/514 439/214
8,033,867 B1 * 10/2011 Kessler ..... H01R 25/14 439/652
8,217,528 B2 * 7/2012 Fleisig ..... H01R 25/003 307/11
8,267,705 B2 * 9/2012 Huang ..... H01R 31/06 439/171
8,382,526 B2 * 2/2013 Chen ..... H01R 13/639 439/655
8,579,641 B1 * 11/2013 Queru ..... H01R 33/7671 439/224
8,708,722 B1 * 4/2014 Walliser ..... H01R 13/6675 439/172
8,736,106 B2 * 5/2014 Byrne ..... H01R 31/02 307/42
8,894,419 B1 * 11/2014 Buelow ..... H01R 13/6205 439/39
8,941,976 B1 * 1/2015 Maroney ..... H04B 3/54 361/637
9,312,673 B2 * 4/2016 Byrne ..... H02G 3/185
9,425,566 B2 * 8/2016 Lee ..... H01R 25/003
9,484,659 B1 * 11/2016 Lee ..... H01R 24/78
9,647,375 B2 * 5/2017 Lee ..... H01R 13/4534
9,755,357 B1 * 9/2017 Kim ..... H01R 43/26
9,859,670 B1 * 1/2018 Liao ..... H01R 27/00
10,175,996 B2 * 1/2019 Byrne ..... G04G 9/02
2004/0147157 A1 * 7/2004 Burton ..... H01R 9/2475 439/346
2010/0099287 A1 * 4/2010 Colburn ..... H01R 27/00 439/224
2011/0003505 A1 * 1/2011 Greig ..... B64D 11/0624 439/540.1
2012/0200989 A1 * 8/2012 Byrne ..... H01R 13/447 361/641
2016/0301153 A1 * 10/2016 Lee ..... H01R 24/78
2018/0212383 A1 * 7/2018 Liao ..... H01R 31/06
2019/0356097 A1 * 11/2019 Landwehr ..... H01R 27/00
2020/0059052 A1 * 2/2020 Joo ..... H01R 13/631

* cited by examiner

REPLACEABLE SOCKET DEVICE

RELATED APPLICATIONS

This application is a Continuation Application of U.S. Utility patent application Ser. No. 15/649,100 filed on Jul. 13, 2017, claims the benefit of priority under 35 USC § 119(e) of U.S. Provisional Patent Application No. 62/409,135 filed on Oct. 17, 2016. The contents of the above applications are all incorporated by reference as if fully set forth herein in their entirety.

FIELD AND BACKGROUND OF THE INVENTION

This disclosure relates to a replaceable socket device, and more particularly to a replaceable socket device widely utilized in various types of jacks.

The sockets for domestic and commercial electricity are generally categorized into types utilized in 110-120V or 220-240V. The 110V-120V socket is further divided into a two-hole type and a three-hole type. Therefore, the type of the sockets has to be chosen in advance before installing or purchasing sockets. For example, the three-hole type sockets utilized to 220-240V should be installed nearby where the air-conditioner will be set, and the two-hope type or the three-hole type sockets utilized in 110-120V should be installed nearby where the electronic appliances will be set. In addition, not only should the voltage should be considered, the types of sockets should be noted as well in case, for example, the three-pin plug will not fit the two-hole sockets. Furthermore, the plugs have to be inserted in specific direction, in this situation, the power cable will be curved and the insulation layer of the power cable may rupture, resulting in leakage of electricity or a short circuit.

The electronic appliances which are purchased overseas cannot be used anymore since the sockets do not fit the plugs. Although there are adapters available on the markets, however, it's inconvenient to attach an adapter on the plug, and occupy more space and sometimes cause danger due to the low-quality of the adapters.

Furthermore, the Power Line Communication (PLC) technologies allow the network data to be transmitted by the power cables. The PLC technologies requires modems installed on sockets or network bridge with PLC functions, however it's inconvenient to attach an adapter on the plug, and occupy more space as well.

SUMMARY OF THE INVENTION

The purpose of the present disclosure is to provide a replaceable socket device which can choose proper adapters set on a base according the specification or the type of plug. The adapters of present disclosure are non-directional, which can be adjusted or turn directions as wished. In addition, a safety component could be added to the replaceable socket device to avoid danger.

The present disclosure provides a replaceable socket device including a plurality of adapters, a base, a plug, and an adapting interface. Each of the adapters include a jack and a plurality of contacts. The jacks are disposed on a top of the adapters for transmitting electrical signal to an external device. The plurality of contacts are disposed on a bottom of the adapters. The adapter couples to external power via the plurality of contacts. The base includes a socket utilized to engaging with one of the plurality of adapters. The plug is connected to an external power. The adapting interface is disposed on the socket, and utilized to connect the socket and the adapter. The structure of the adapting interface corresponds to the plurality of contacts, for allowing the one or more adapters to couple to the one or more sockets via the adapting interface.

The replaceable socket device of present disclosure can change or turn the adapters when needed. There is a magnetic connection between the adapters and the adapting interface to allow the adapters to be installed more stably. The bases have different types of shapes, thus users can choose the proper or desired shapes. The separable cable interface allows the power cable to be separated when not in use. In conclusion, the replaceable socket device of present disclosure is useful, functional, and handy and considers safety at the same time.

The preferable embodiments and drawings will be provided as follows to make the description above easier to understand.

DESCRIPTION OF SPECIFIC EMBODIMENTS OF THE INVENTION

To comprehend the features, methods, intended functions, and objects of the present disclosure, the practical embodiments will be listed, and the figures and the illustration numbers are as follows.

The structure and the technical means adopted by the present invention to achieve the above and other objects can be best understood by referring to the following detailed description of the preferred embodiments and the accompanying drawings. Furthermore, directional terms described by the present invention, such as upper, lower, front, back, left, right, inner, outer, side, longitudinal/vertical, transverse/horizontal, etc., are only directions by referring to the accompanying drawings, and thus the used directional terms are used to describe and understand the present invention, but the present invention is not limited thereto.

Figure 1:
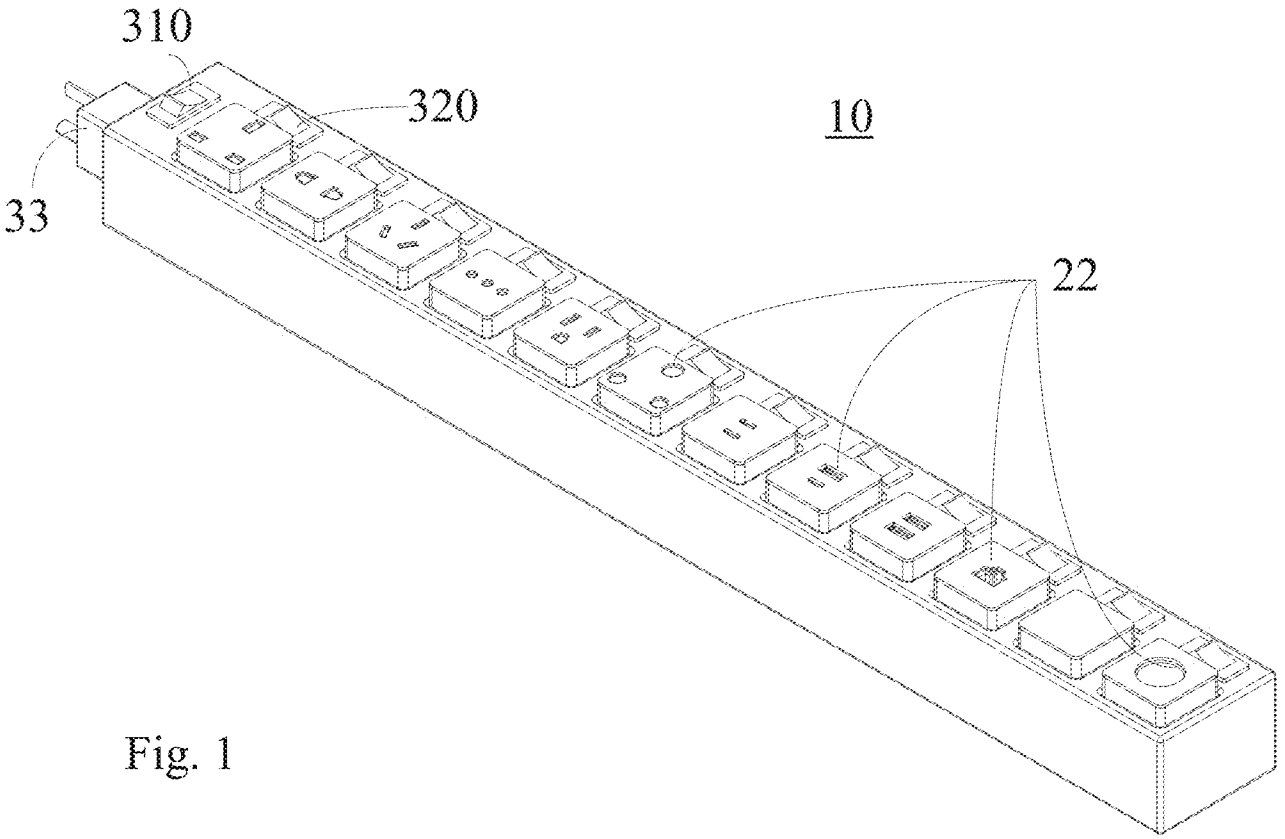
FIG. 1 illustrates a replaceable socket device of the present disclosure.
Figure 2:
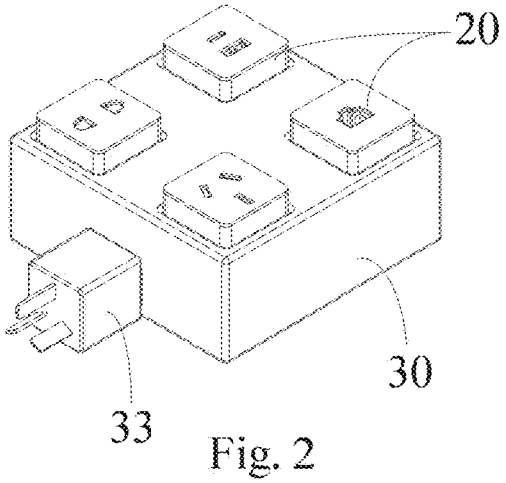
FIG. 2 illustrates a replaceable socket device having a rectangular base of the present disclosure.
Figure 3:
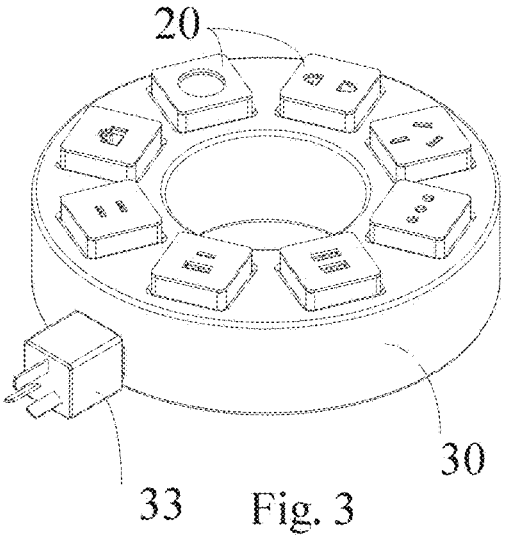
FIG. 3 illustrates a replaceable socket device having a circular base of the present disclosure.
Figure 4:
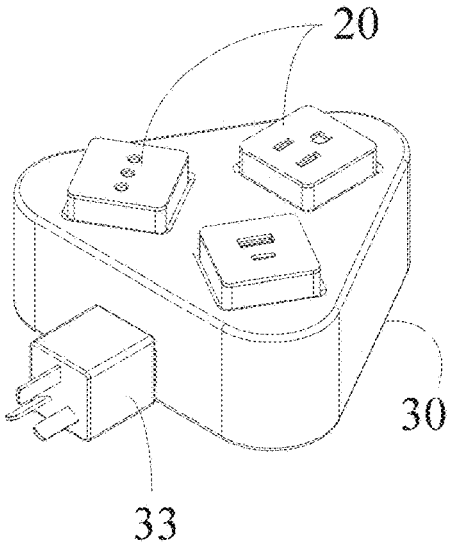
FIG. 4 illustrates the replaceable socket device having a triangular base of the present disclosure.

Please refer to FIG. 1 to FIG. 4, which illustrate four kinds of shapes of the replaceable socket device 10. The replaceable socket device 10 includes a plurality of adapters 20, a base 30, and a plug 33. The plug 33 can insert into a socket of a domestic electricity source to receive alternating current power. The plug 33 could be a separable plug which allows the plug 33 to be separated from the base 30. The plug 33 could be for 110-120V or 220-240V electricity for domestic or commercial purpose. The plug 33 also could be a Type-A power plug, a Type-B power plug, a Type-C power plug, a Type-D power plug, a Type-E power plug, a Type-F power plug, a Type-G power plug, a Type-H power plug, a Type-I power plug, a Type-J power plug, a Type-K power plug, a Type-L power plug, and other types of power plug utilized to the domestic and commercial electricity. The base 30 could be different shape like a rectangle, square, circle, triangle, etc., as shown in FIG. 2, FIG. 3, and FIG. 4. The adapters 20 located on the base 30 could be arranged in array as shown in FIG. 2, or arranged in circuit as shown in FIG. 3 and FIG. 4. The shapes of the base 30 and the arrangements of the adapters 20 are just examples for present disclosure. Any shapes of the base 30 and the arrangements of the adapters 20 all fall into the scope of present disclosure.

Figure 5:
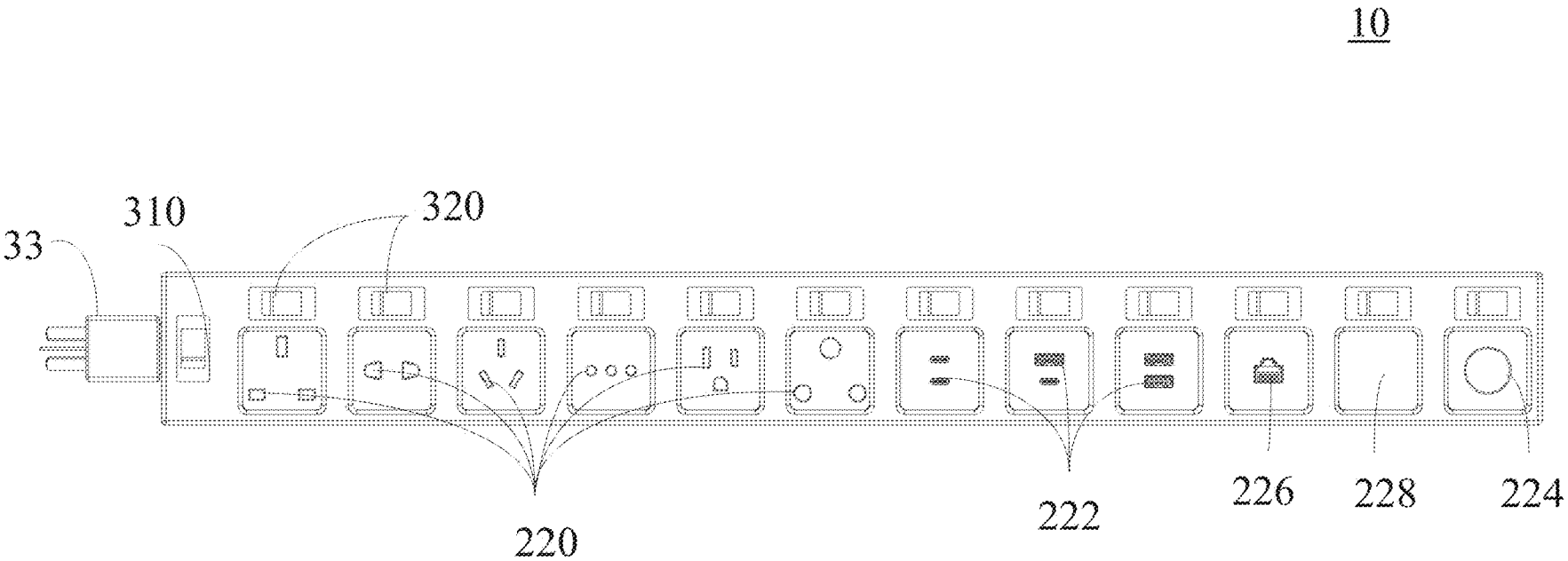
FIG. 5 illustrates the top view of a replaceable socket device of the present disclosure.
Figure 6:
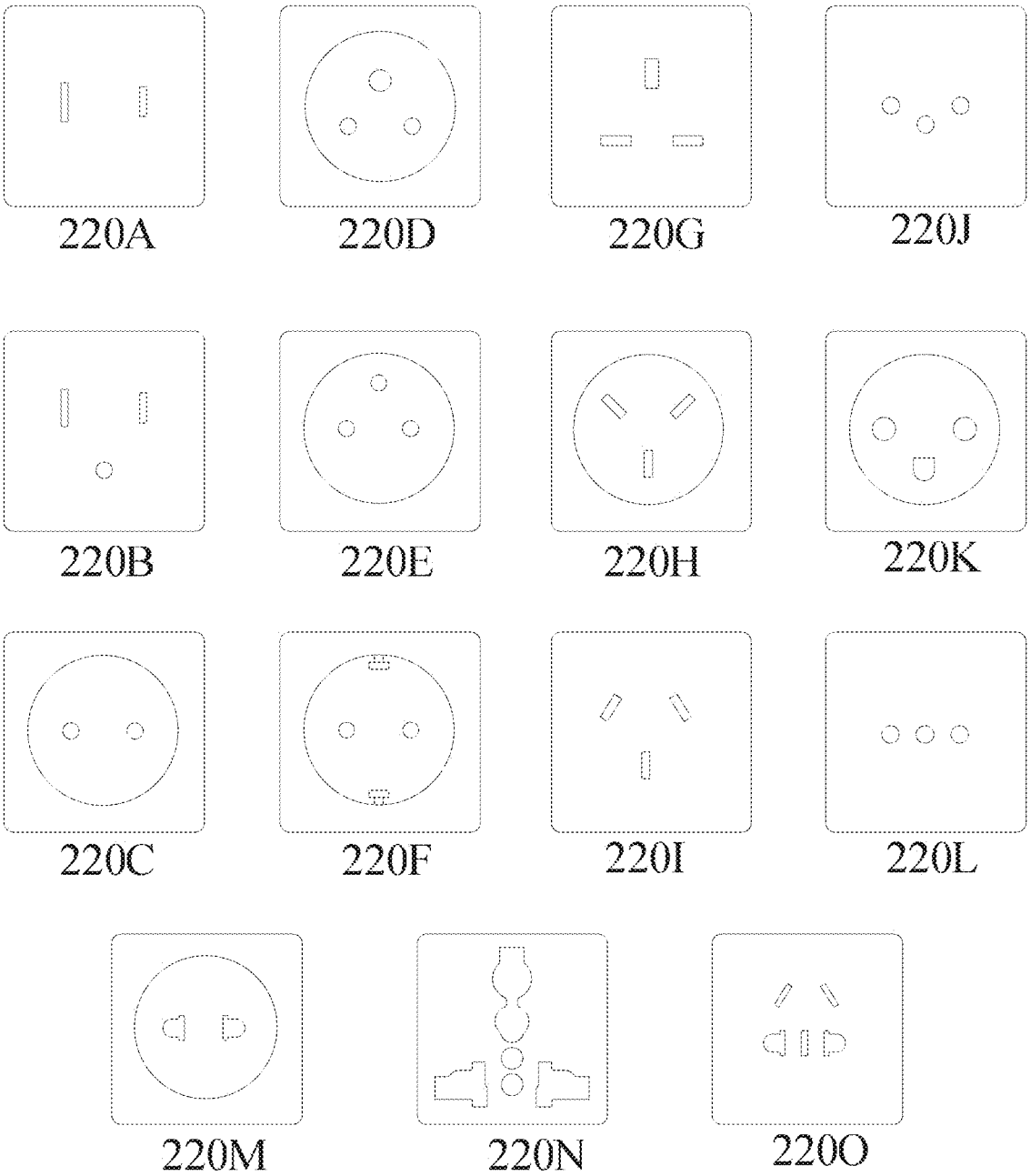
FIG. 6 illustrates the jacks of a replaceable socket device of the present disclosure.

Please refer to FIG. 5, which is the top view of the replaceable socket device 10 in FIG. 1. There is a jack 22 disposed on a top of the adapter 20 which allows a plug to be inserted in for power supplement. As shown in FIG. 5, the jack 22 could be a power jack 220 for 110-120V or 220-240V electricity for domestic or commercial purpose. The power jack could further be any type of jack that is utilized in a different country. For example, as shown in FIG. 6, the jack 22 could be a Type-A power jack 220A, a Type-B power jack 220B, a Type-C power jack 220C, a Type-D power jack 220D, a Type-E power jack 220E, a Type-F power jack 220F, a Type-G power jack 220G, a Type-H power jack 220H, a Type-I power jack 220I, a Type-J power jack 220J, a Type-K power jack 220K, a Type-L power jack 220L, a common power jack 220M which applies to both Type-A and Type-C, multi-country universal power jack 220N and 2200 which apply to multiple types of power jacks and other types of power jacks utilized to the domestic and commercial electricity.

In addition, the jack 22 could be a USB (Universal Serial Bus) jack 222, as shown in FIG. 5, for transmitting a signal through USB2.0, USB 2.0 Standard A, USB 2.0 Type C, USB 3.0, USB 3.1 or any type of transmission protocols which can apply to USB jacks. The jack 22 could also be a 12V jack 224 that applies to the car cigarette lighter.

Figure 7:
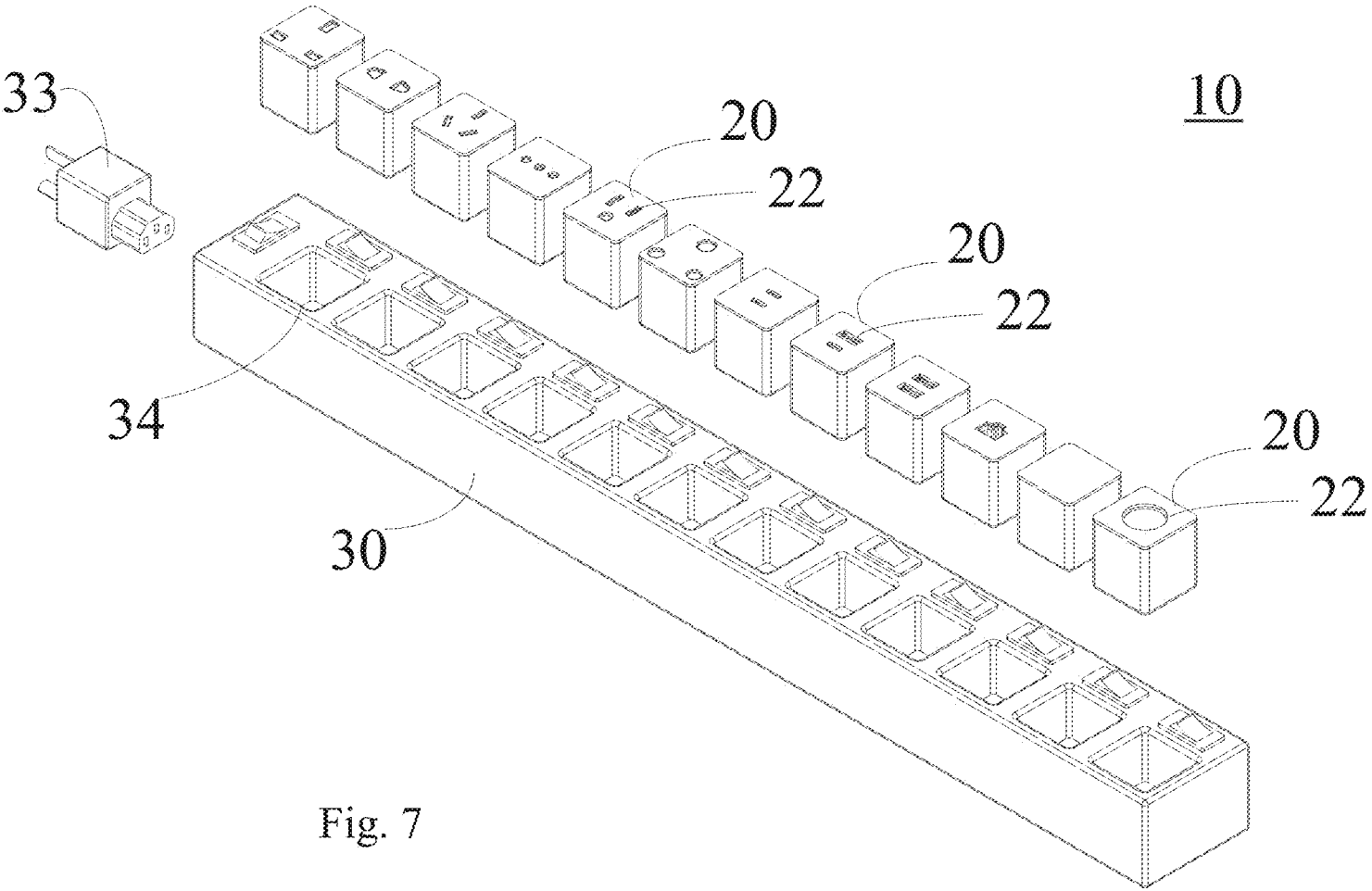
FIG. 7 illustrates the exploded view of a replaceable socket device of the present disclosure.
Figure 8:
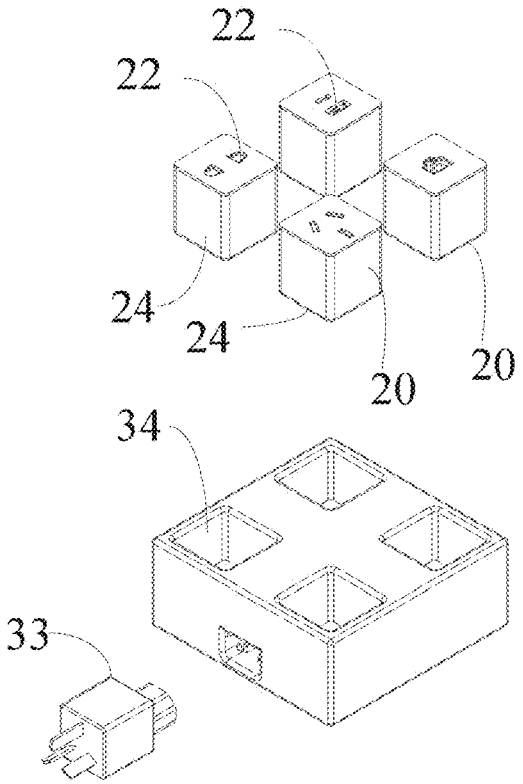
FIG. 8 illustrates the exploded view of a replaceable socket device having rectangular base of the present disclosure.

Please refer to FIG. 7 and FIG. 8, which are exploded views of the replaceable socket device in FIG. 1 and FIG. 2. There is a jack 22 disposed on a top of the adapter 20 and contacts 24 disposed on a bottom of the adapter 20. The base 30 includes one or more sockets 34.

Figure 9:
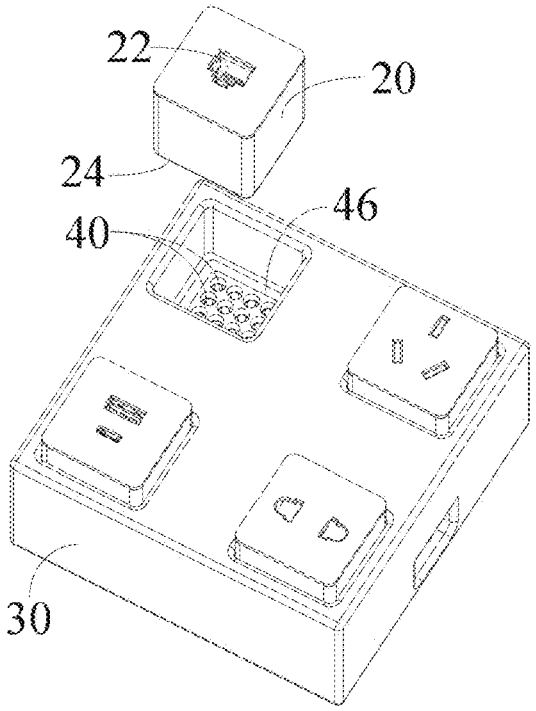
FIG. 9 illustrates the base in detail of a replaceable socket device of the present disclosure.

Please refer to FIG. 9, which illustrates an enlarged view of the contacts 24 and the sockets 34. There is a jack 22 disposed on a top of the adapter 20 and contacts 24 disposed on a bottom of the adapter 20. There is an adapting interface 40 disposed on the socket 34.

Figure 10:
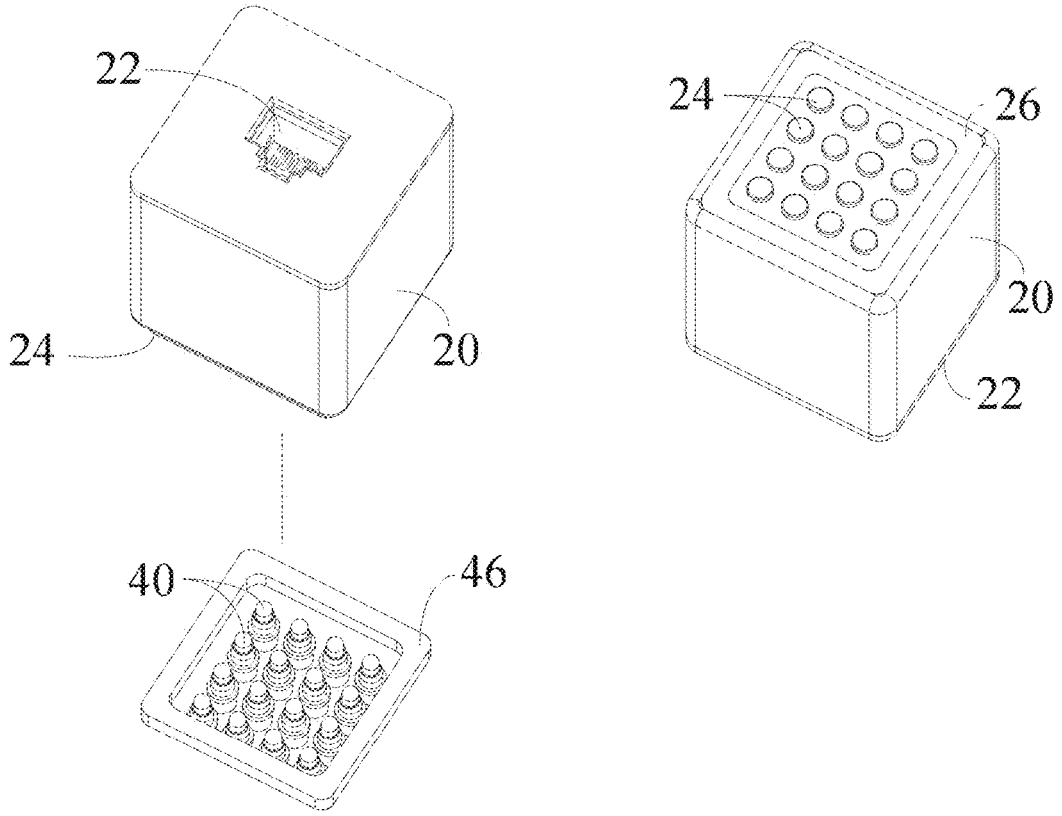
FIG. 10 illustrates the contacts and adapting interface in detail of a replaceable socket device of the present disclosure.
Figure 11:
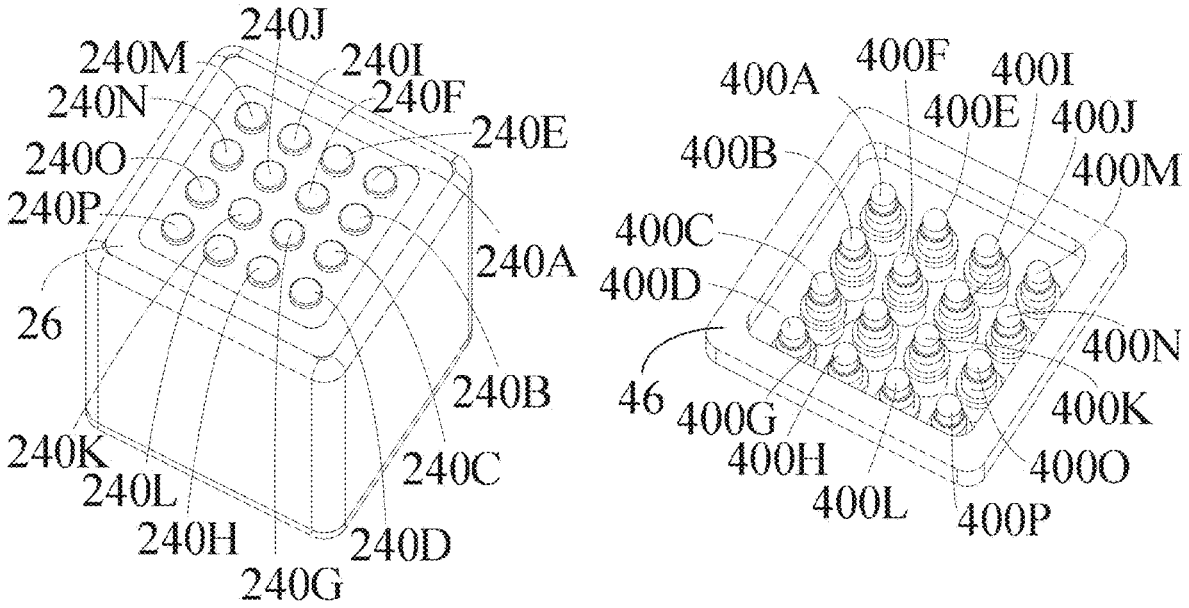
FIG. 11 illustrates the contacts and the adapting interface in detail of the first embodiment.
Figure 12:
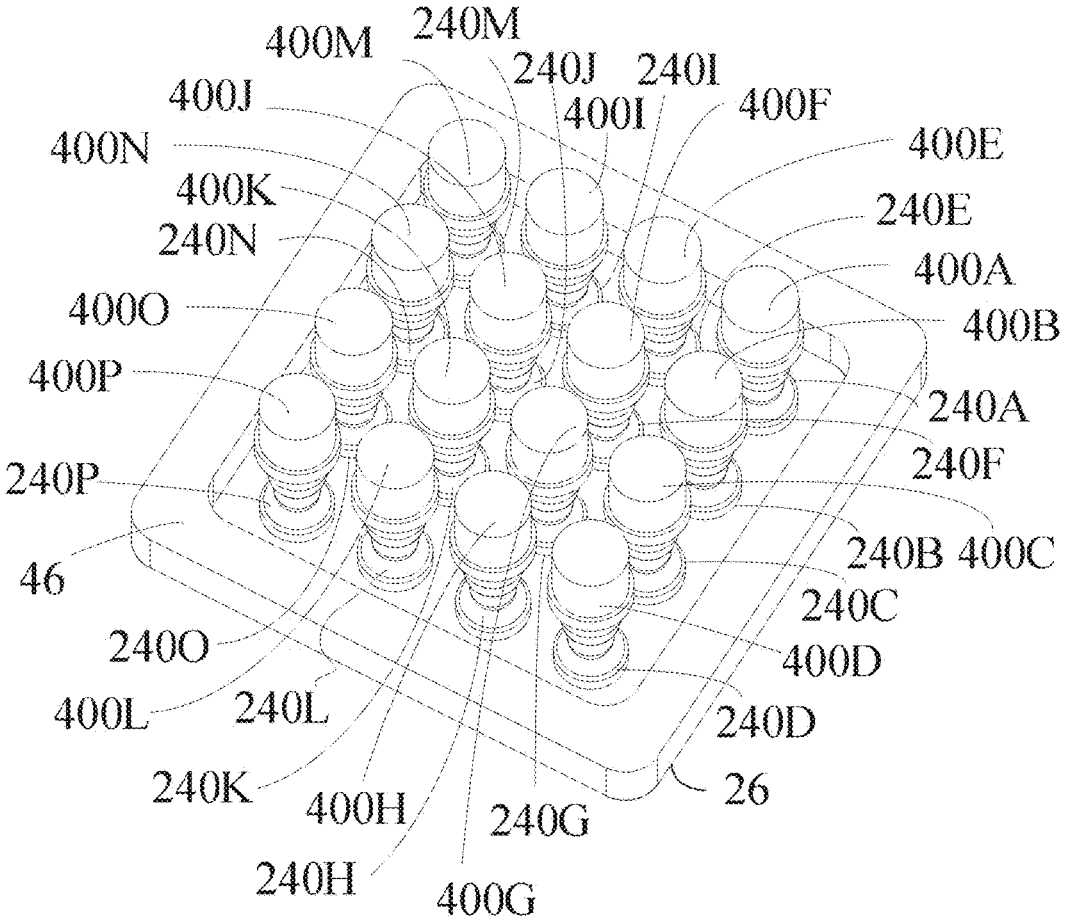
FIG. 12 illustrates the structure of the first embodiment in detail after the contacts and the adapting interface are connected to each other.

Please refer to FIG. 10, which shows the structure of the contact 24 after turning the adapters 20 over. The structures of the adapting interface 40 correspond to the contacts 24. The details of the contacts 24 and the adapting interface 40 are as shown in FIG. 11. Please refer to FIG. 11, there are POGO PINs 400A-400P disposed on the adapting interface 40, and there are flat connectors 240A-240P, which correspond to the POGO PINs 400A-400P, disposed on the contacts 24. The POGO PIN 400A connects to the flat connector 240A. The POGO PIN 400B connects to the flat connector 240B. The POGO PIN 400P connects to the flat connector 240P. The structures of the contacts 24 and the adapting interface 40 when they are connecting to each other are shown in FIG. 12. The POGO PINs 400A-400P connect to the flat connectors 240A-240P to make the power be transmitted from the base 30 to the jack 22.

Figure 13:
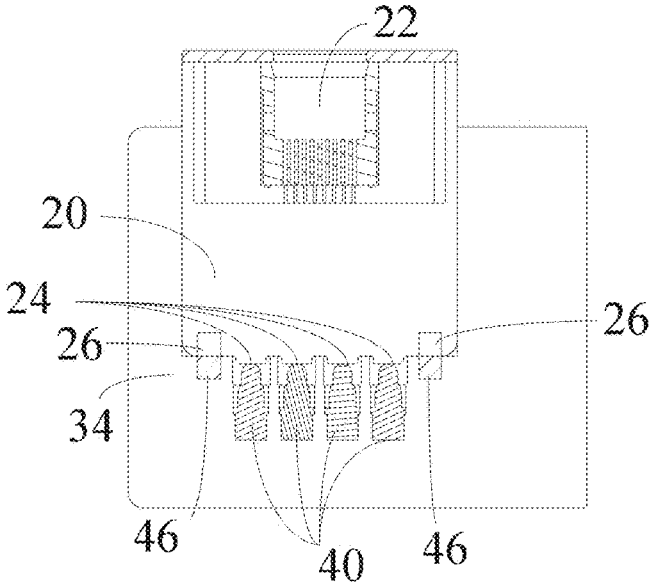
FIG. 13 illustrates the cross-section view of the first embodiment after the contacts and the adapting interface are connected to each other.

Please refer to FIG. 13, which illustrates the cross-section view of the POGO PINs 400A-400P and the flat connectors 240A-240P when they are connected to each other. The adapter 20 couples to the socket 34 via the contacts 24 and the adapting interface 40 so that the power can be transmitted from the base 30 to the jack 22. In the preferable embodiment, the height of the POGO PIN 400A-400B is not beyond the horizontal line of the top plane of the socket 34.

In addition, there is still a first magnetic part 26 located on the adapter 20, and a second magnetic part 46 located on the adapting interface 40 where the first magnetic part 26 magnetically connects to the second magnetic part 46. The first magnetic part 26 and the second magnetic part 46 can connect to each other at any time, or connect to each other only if there is power existing. For example, first magnetic part 26 located on the adapter 20 could be an electromagnet. When the adapter 20 is set on the socket 34, the first magnetic part 26 connects to the external power via base 30 so the first magnetic part 26 possess magnetism that allows the first magnetic part 26 to magnetically connect to the second magnetic part 46. In another embodiment, the first magnetic part 26 is an electromagnet which does not possess magnetism since the power has not been conducted when the adapter 20 is set on the socket 34. After the plug of an electronic device is inserted into the jack 22, the power will be supplied to the electronic device and the first magnetic part 26 to make the first magnetic part 26 possess magnetism so that the first magnetic part 26 can magnetically connect to the second magnetic part 46. The adapter 20 could be fixed securely on the socket 34 through the connection between the first magnetic part 26 and the second magnetic part 46, thus that replaceable socket device will be safer. The first magnetic part 26 being an electromagnet is just one of the embodiments. The second magnetic part 46 can be an electromagnet as well. Moreover, the present disclosure does not limit to use electromagnets to get the magnetic connection. Any materials which can make the first magnetic part 26 and the second magnetic part 46 magnetically connect to each other fall into the scope of the present disclosure.

Figure 14:
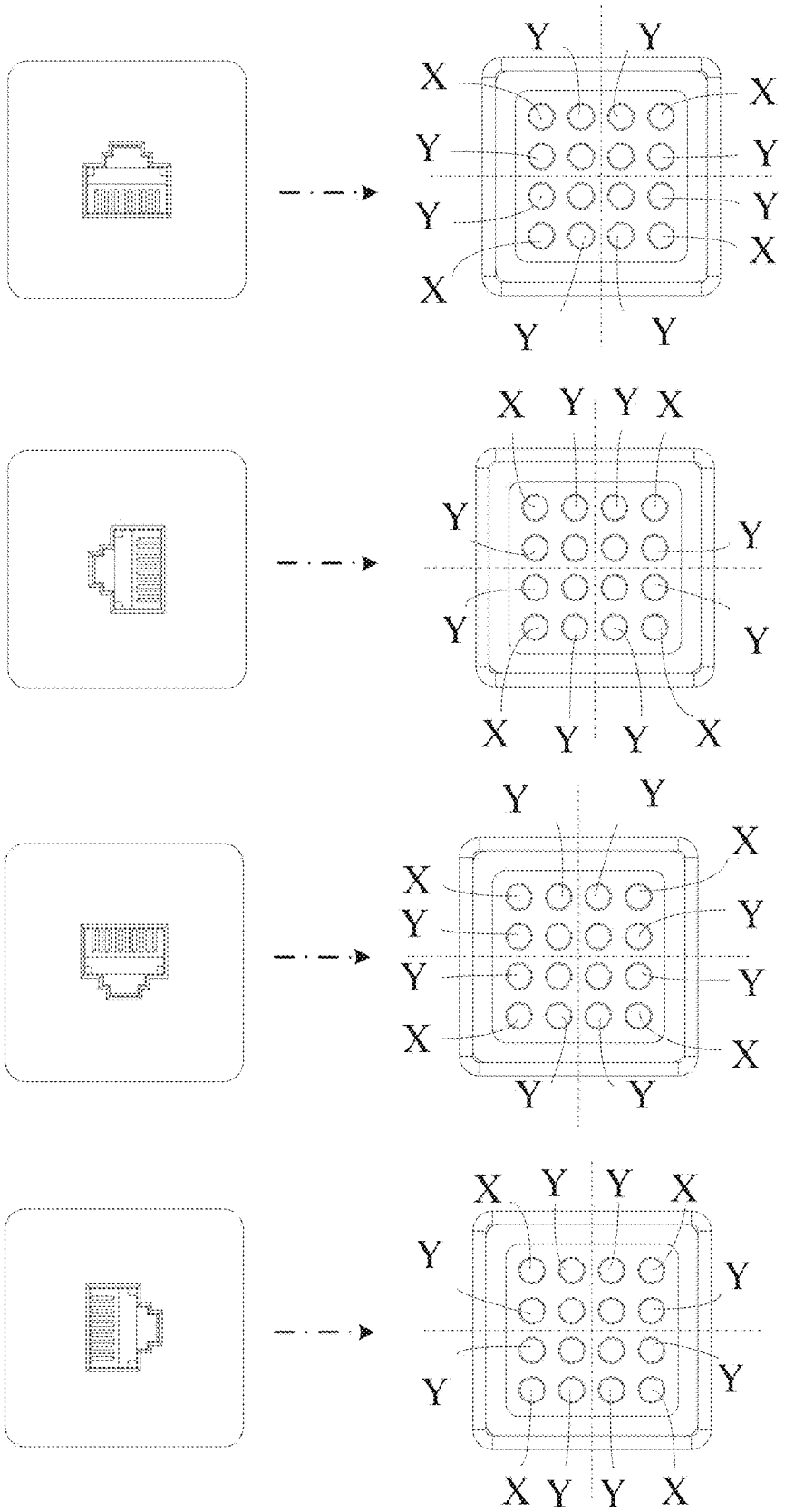
FIG. 14 illustrates the diagram of the first embodiment which divides the potential of the contact points into two groups.

The potential of each contacting point of the contacts 24 and the adapting interface 40 are different, which may divide into the live lines, neutral lines or earth lines (ground lines). The contacting point of the contact 24 and the adapting interface 40 could be divided into several groups according to the types of the jack 22. For example, the adapting interface 40 can be grouped into the first potential and the second potential which may correspond to live lines and neutral lines. For another example, the adapting interface 40 can be grouped into the first potential, the second potential, and the third potential which may represent to the live lines, neutral lines, and earth (ground) lines. The structures of the adapter 20 of present disclosure could be designed to be non-directional. The flat connectors corresponding to the POGO PINs mentioned in FIG. 9-FIG. 13 could be grouped into two groups, live lines and neutral lines, according to the potential. As shown in FIG. 14, take flat connectors 240A-240P as example, the contacting point of the flat connectors and the POGO PINs could be divided into X group and Y group. And the arrangement of the group makes the contacting points stay in the same order no matter how the adapter 20 turns.

Figure 15:
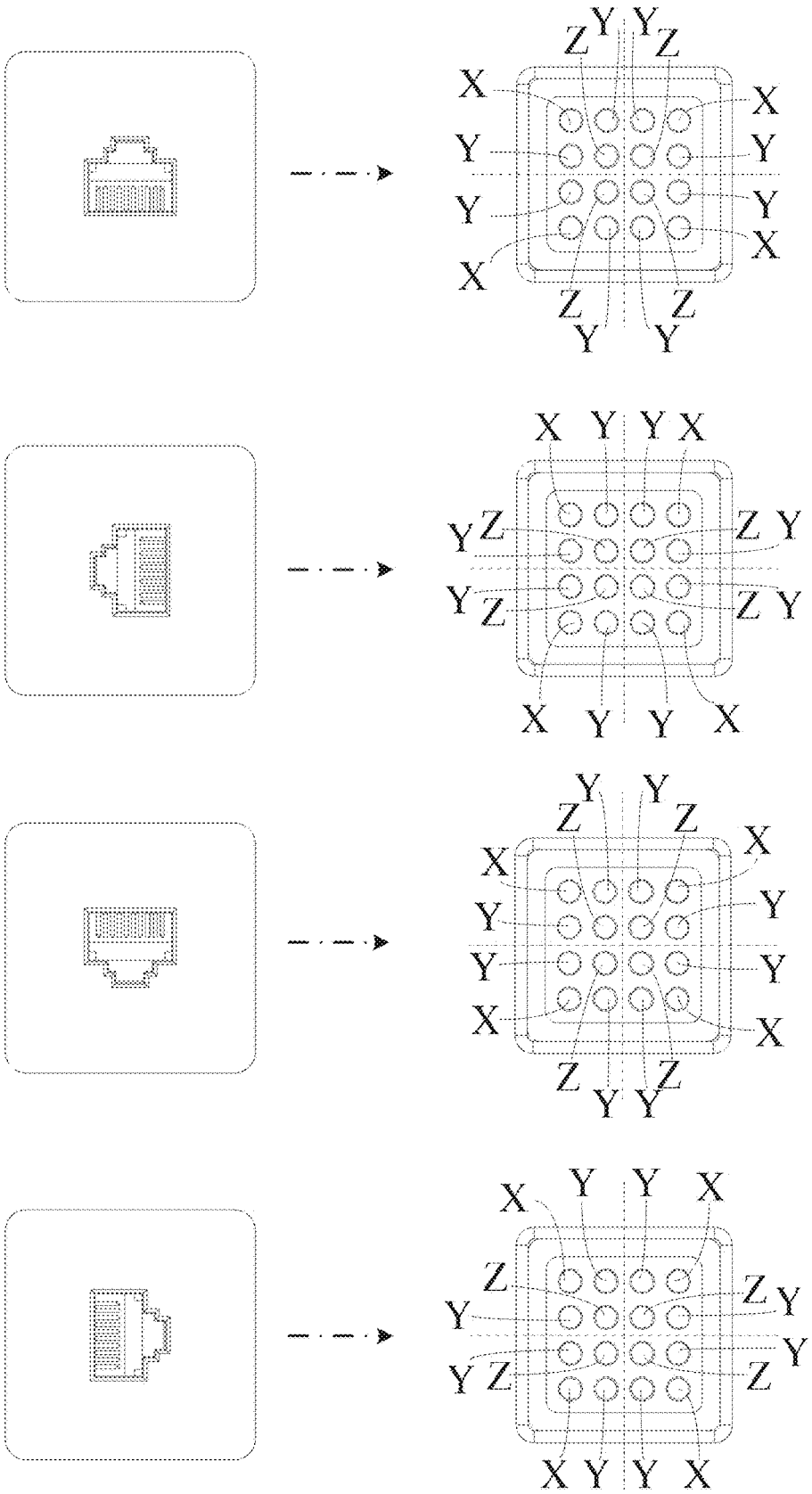
FIG. 15 illustrates the diagram of the first embodiment which divides the potential of the contact points into three groups.

The 16 contacting points can further divide into three groups of live lines, neutral lines, or earth (ground) lines. As shown in FIG. 15, the 16 contacting points are divided into three groups: X, Y, and Z. The arrangement make the order of the 16 contacting points remain the same no matter how the adapter 20 turns. Therefore, the adapter 20 can be set on the socket 34 regardless the direction so that the adapter 20 could be turned into any direction as wished.

Figure 16:
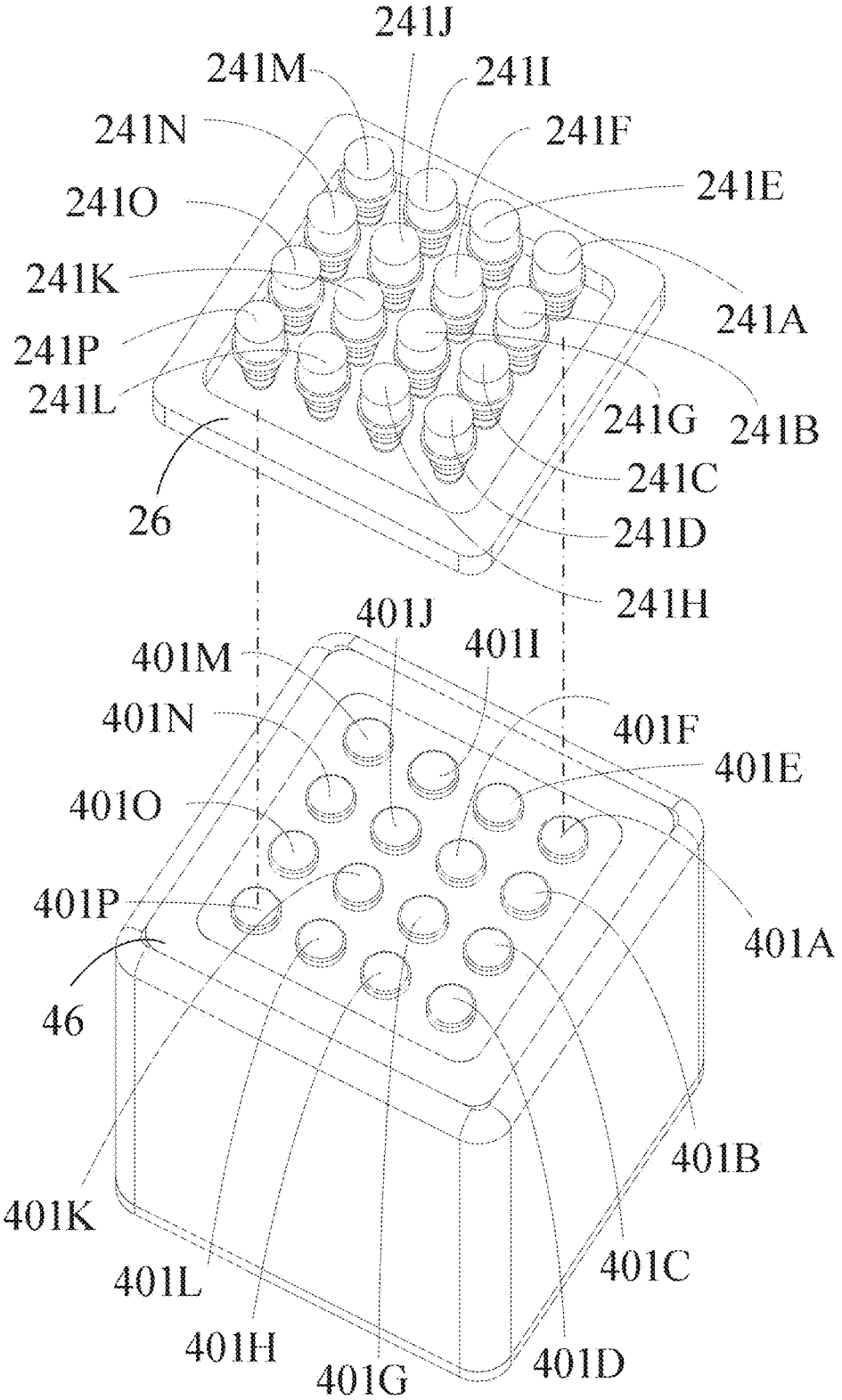
FIG. 16 illustrates the contacts and the adapting interface in detail of the second embodiment.

Please refer to FIG. 16 which shows the second embodiment. It is worth mentioning that the POGO PINs can not only be disposed on the adapting interface 40, but can also be disposed on the contacts 24. In the meanwhile, there are corresponding flat connectors disposed on the adapting interface 40. In this embodiment, the contacts 24 include POGO PINs 241A-241P, and the adapting interface 40 includes the flat connectors 401A-401P. The POGO PIN 241A connects to the flat connector 401A. The POGO PIN 241B connects to the flat connector 401B. The POGO PIN 241P connects to the flat connector 401P. The cross-section view of the POGO PINs and the flat connectors after they connect to each other can take FIG. 13 as reference. The only difference between the second embodiment and the first embodiment is that the flat connectors are located on the socket 34 and the POGO PINs are located on the adapter 20. Furthermore, in the preferred embodiment, the heights of the POGO PINs located on the adapting interface 40 are not beyond the horizontal line of the top plan of the socket 34 when the flat connectors located on the adapter 20.

Figure 17:
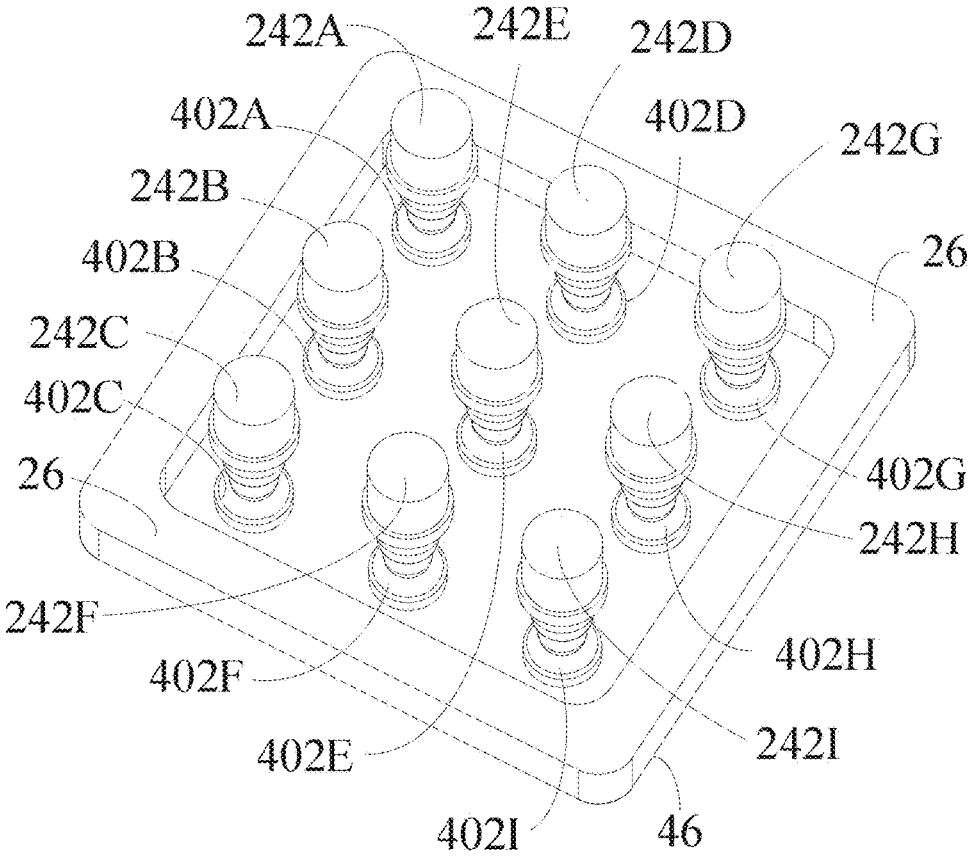
FIG. 17 illustrates the structure of the third embodiment in detail after the contacts and the adapting interface are connected to each other.
Figure 18:
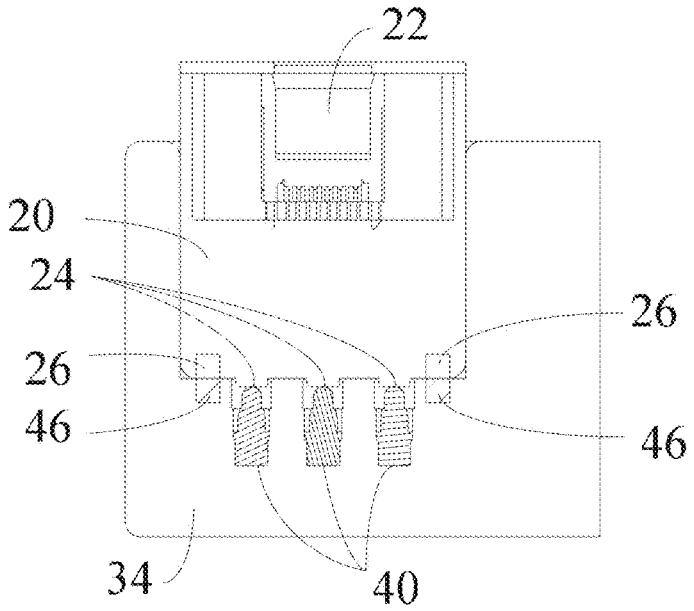
FIG. 18 illustrates the cross-section view of the forth embodiment after the contacts and the adapting interface are connected to each other.

Please refer to FIG. 17 which illustrates the third embodiment. The contacts 24 and the adapting interface 40 have 9 contacting points. The contacts 24 include POGO PINs 242A-242I. The adapting interface 40 includes flat connectors 402A-402I which correspond to the POGO PINs 242A-242I, respectively. The cross-section view of the POGO PINs and the flat connectors after they connect to each other can take FIG. 18 as reference. The only difference between the third embodiment and FIG. 18 is that the flat connectors 402A-402I are located on the socket 34 and the POGO PINs 242A-242I are located on the adapter 20. FIG. 18 illustrates the cross-section view of the POGO PINs 242A-242I and the flat connectors 402A-402I after they connect to each other. The adapter 20 couples to the socket 34 through the contacts 24 and the adapting interface 40 so that the power can be transmitted from base 30 to jack 22

In the fourth embodiment, the POGO PIN can be located on the adapting interface 40 and the flat connectors corresponding to the POGO PINs can be located on adapter 20. The cross-section view of the forth embodiment can take FIG. 13 as reference. Furthermore, in the preferred embodiment, the heights of the POGO PINs located on the adapting interface 40 are not beyond the top horizontal line of the top plan of the socket 34 when the flat connectors located on the adapter 20.

Figure 19:
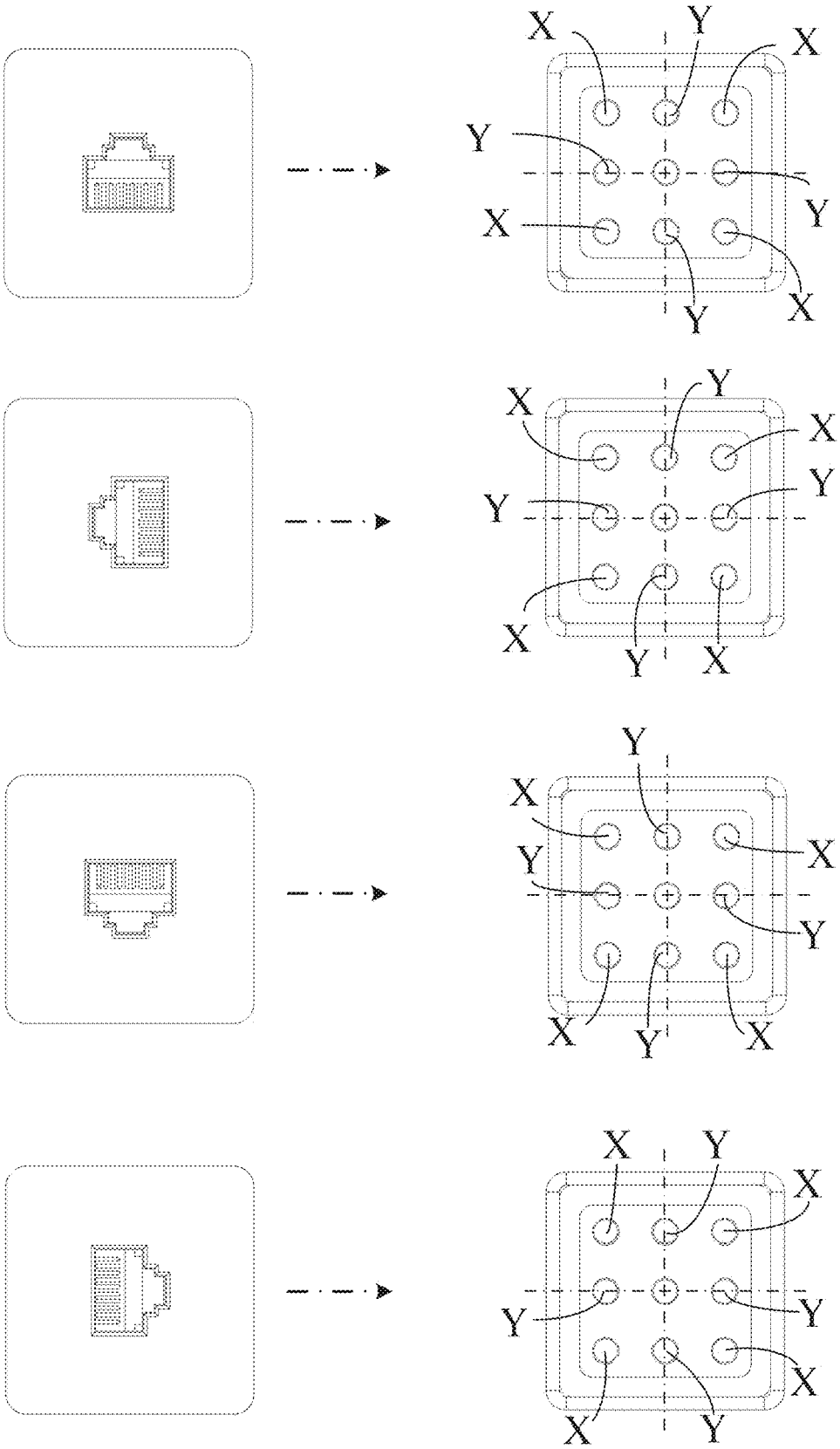
FIG. 19 illustrates the diagram of the third and the forth embodiments which divide the potential of the contact points into two groups.
Figure 20:
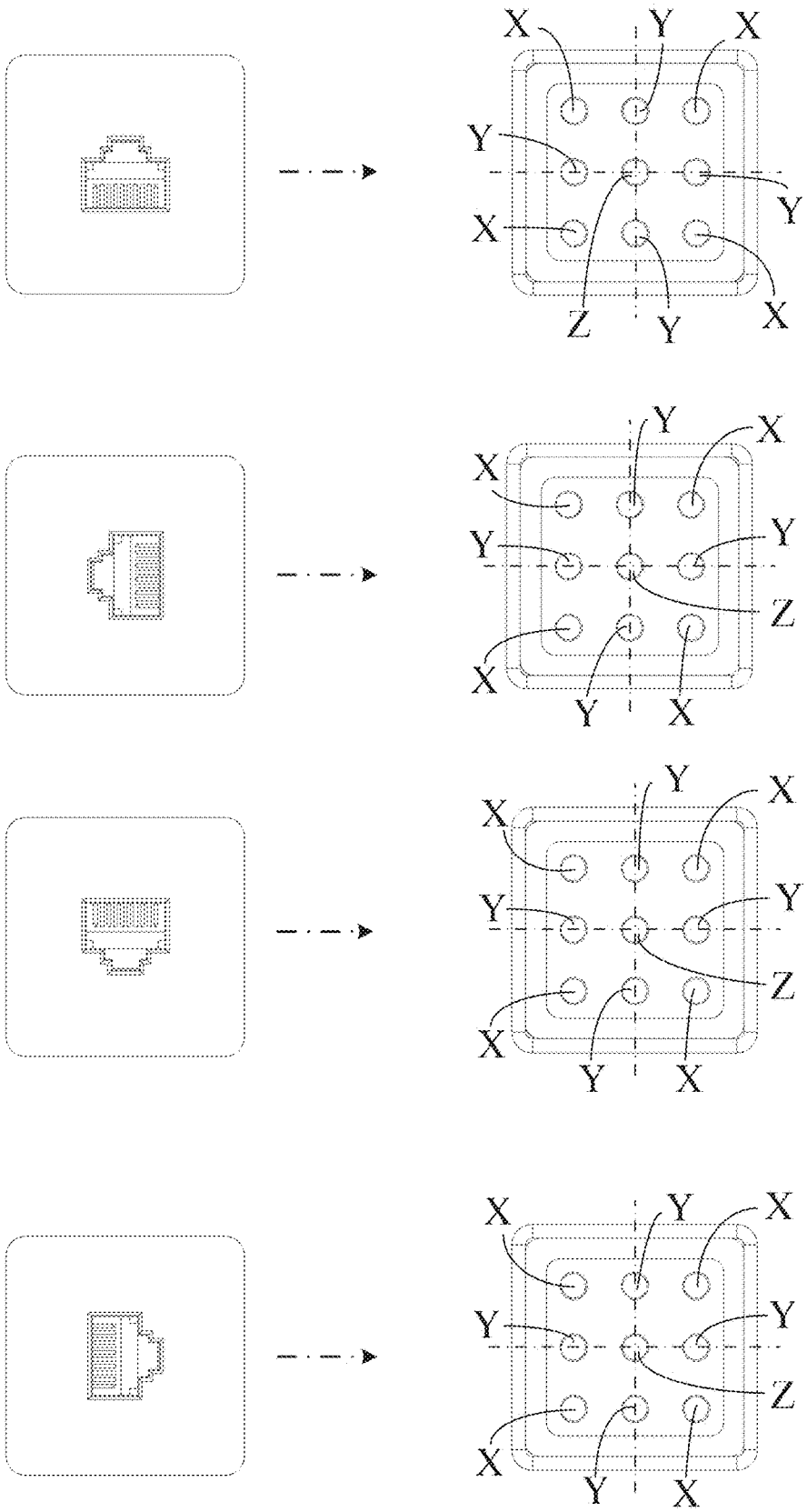
FIG. 20 illustrates the diagram of the third and the fourth embodiments which dividing the potential of the contact points into three groups.

The contacting points of the third embodiment and the forth embodiment can be grouped as the first and the second embodiment. Please refer to FIG. 19, take the flat connectors 402A-402I as example, the flat connectors can be divide into X group and Y group so that the arrangement of X and Y will remain the same no matter how the adapting interface 40 turns. Or refer to FIG. 20, the contacting points of the contacts 24 and the adapting interface 40 could be divided into three groups which represent live lines, neutral lines, and earth (ground) lines. The arrangement as shown in FIG. 20 makes the order of the X, Y, and Z remain the same so that the adapter 20 can fit the adapting interface 40 no matter how the adapting interface turns.

The contacts 24 and the adapting interface 40 of the replaceable socket device 10 can also be any type of contact and connector other than POGO PINs and flat connectors, like U-type contacts, square contacts, or circular contacts (not shown), cylindrical connectors, square-column connectors, rectangular-column connectors, circular connectors, or square connectors. The details will be illustrated in following paragraph.

Figure 21:
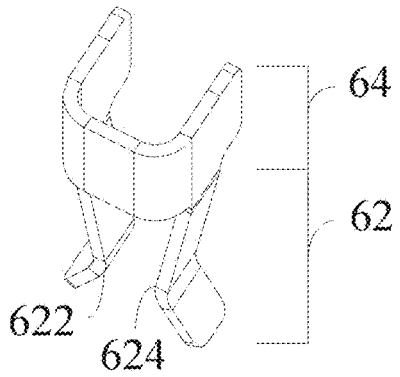
FIG. 21 illustrates the structure of the U-type contact of a replaceable socket device of the present disclosure.

FIG. 21 illustrates the structure of the U-type contact including contact clip 62 and fixing part 64. The contact clip 62 is usually made from metal for coupling to the connectors which have two contact points 622 and 624 with the contact clip 62. The fixing part 64 is utilized to fix the U-type contacts on the adapters 20 or the sockets 34. Please continue to FIG. 22.

Figure 22:
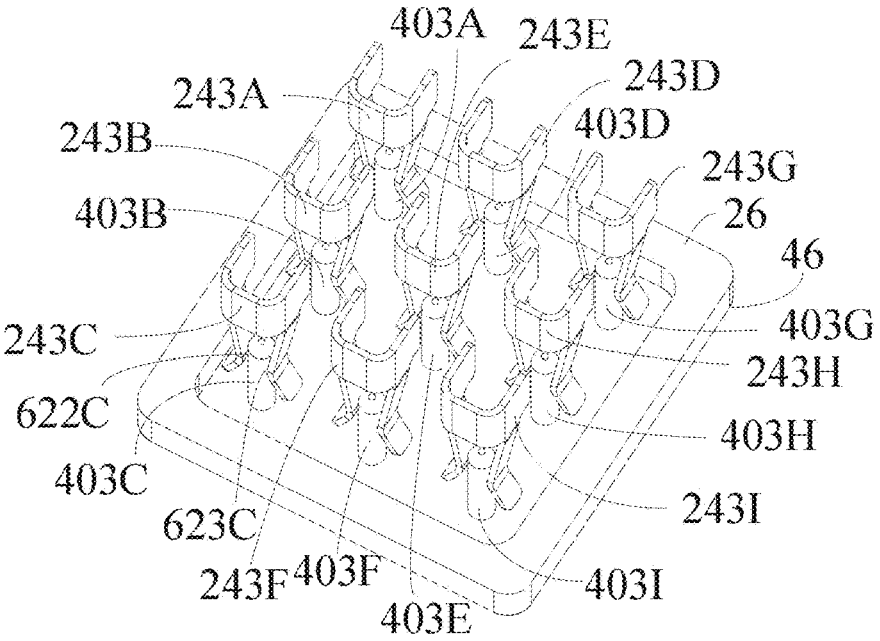
FIG. 22 illustrates the structure of the fifth embodiment in detail after the contacts and the adapting interface are connected to each other.

FIG. 22 illustrates the fifth embodiment. In the fifth embodiment, the contacts 24 consist of 9 U-type contacts 243A-243I. The adapting interface 40 includes 9 cylindrical connectors which correspond to the U-type contacts 243A-243I. In this embodiment, take the U-type contact 243C and the cylindrical connector 403C as an example, the U-type contact 243C and the cylindrical connector 403C have two contact points 622C and 623C. The distance between the contact points 622C and 623C is narrower than the dimension of the cylindrical connector 403C. In addition, the contact clips of the U-type contact 243C are flexible so that they can stably couple to the cylindrical connector 403C.

Figure 23:
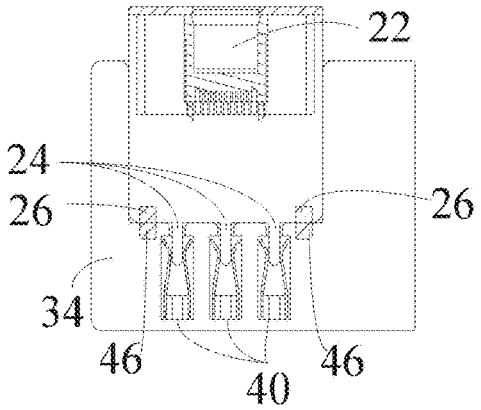
FIG. 23 illustrates the cross-section view of the sixth embodiment after the contacts and the adapting interface are connected to each other.

As in the aforesaid embodiments that includes the POGO PINs and the flat connectors, the positions of the U-type contacts and the cylindrical connectors which are located on the contacts 24 and the adapting interface 40 respectively in the fifth embodiment can be switched. As for the sixth embodiment of the present disclosure, please refer to FIG. 23.

Figure 24:
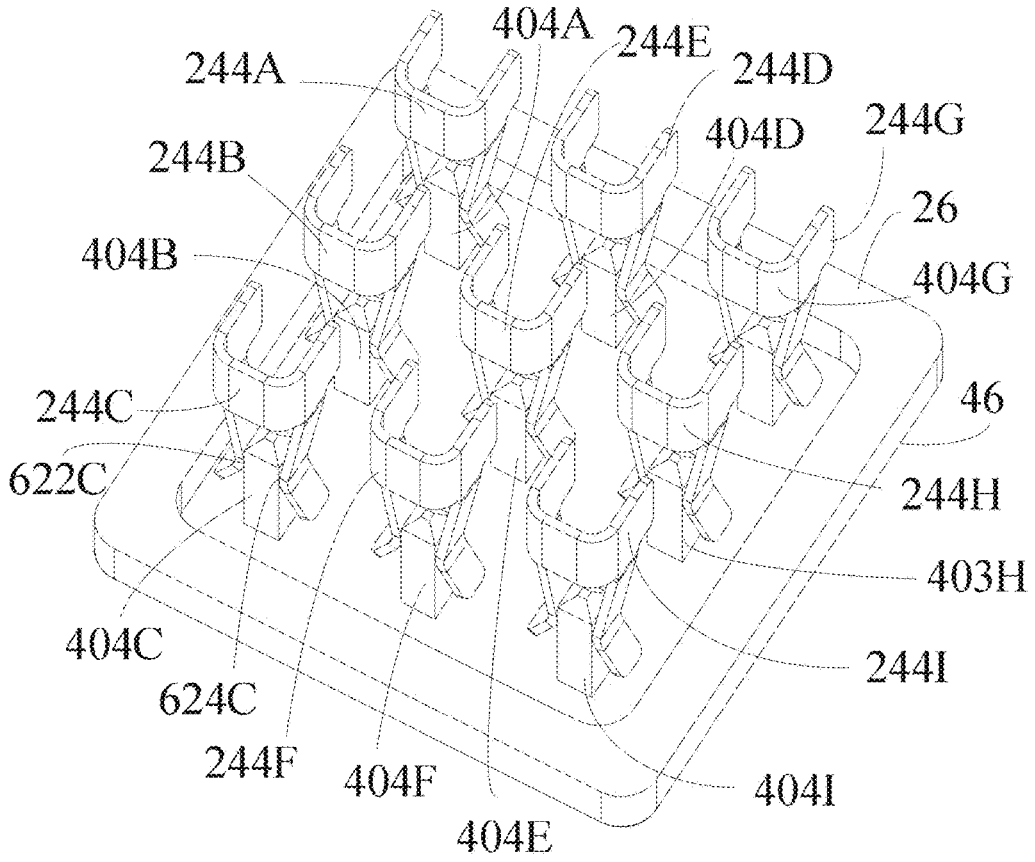
FIG. 24 illustrates the structure of the seventh embodiment in detail after the contacts and the adapting interface are connected to each other.

The connectors corresponding to the U-type contacts could also be square-column connectors, besides the cylindrical connectors, as shown in FIG. 24. FIG. 24 illustrates the seventh embodiment. In the seventh embodiment, the contacts 24 consist of U-type contacts 244A-244I. The adapting interface 40 includes square-column connectors 404A-4041 corresponding to the U-type contacts 244A-244I. In this embodiment, there are two contacting points between the U-type contacts and the contact clip. Take the U-type contact 244C and the square-column connector 404C as an example, the distance between the contact point 622C and 624C are narrower than dimension of the square-column 403C. Therefore, the U-type contact 244C can couple to the square-column connector 404C stably since the U-type contact 244C is flexible.

The adapting interface 40 of the eighth embodiment includes U-type contacts, and the contacts 24 are square-column connectors corresponding to the U-type contacts. The structures and the shape of the U-type contacts and the square-column connectors can take the seventh embodiment as a reference.

The contacts and the connectors of the fifth, sixth, seven, and eighth embodiments can also have 16 contacting points. The contacting points, no matter if there are 9 or 19 contacting points, can be divided into two or three groups by their potential as shown in FIGS. 14, 15, 19 and 20.

Figure 25:
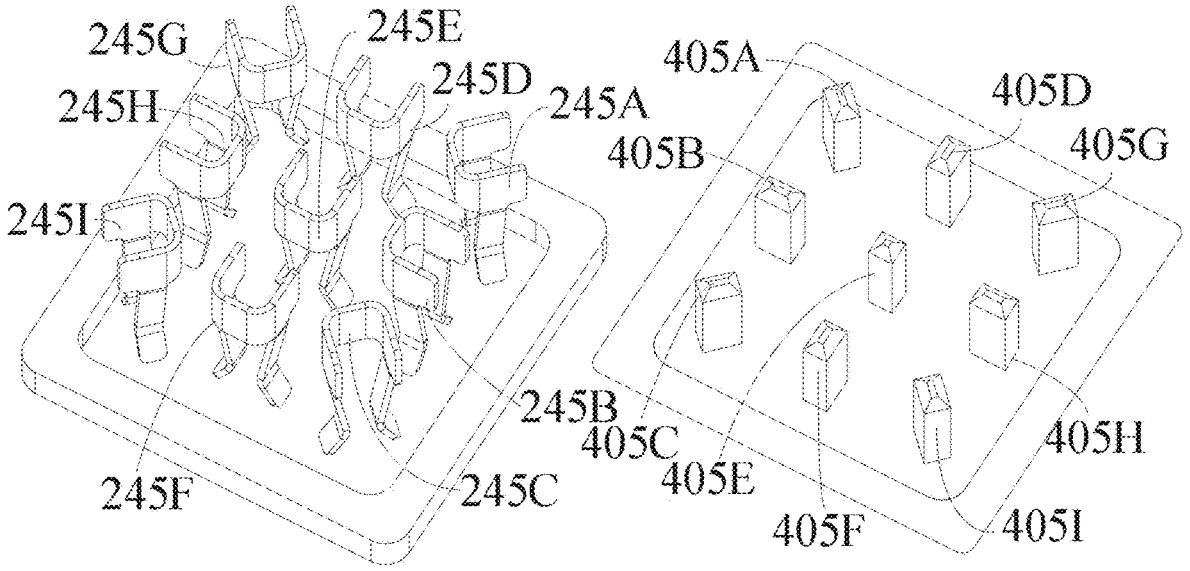
FIG. 25 illustrates the contacts and the adapting interface in detail of the eighth embodiment.

The openings of the U-type contacts are toward the same direction, however, the openings could be arranged toward different directions in order to make the adapters 20 more stable while installed on the sockets 34. The ninth embodiment illustrates an example that the U-type contacts are toward different directions as shown in FIG. 25. In FIG. 25, the contacts consist of 9 U-type contacts 245A-245I which are arranged in three lines. The first line is consisted of 245A-245C, the second line is consisted of 245D-245F, and the third line is consisted of 245G-245I. The U-type contacts 245D-245F in second line are toward to the same direction. The U-type connector 245A of the first line turns right at 45 degrees relative to the U-type connector 245D. The U-type connector 245B turns right at 45 degrees relative to the U-type connector 245A. (That is, turns right at 90 degrees relative to the 245E.) The U-type connector 245C turns right at 45 degrees relative to the U-type connector 245B. (That is, turns right at 135 degrees relative to the 245F.) The U-type connector 245G of the third line turns left at 45 degrees relative to the U-type connector 245D. The U-type connector 245H turns left at 45 degrees relative to the U-type connector 245G. (That is, turns left at 90 degrees relative to the 245E.) The U-type connector 245I turns left at 45 degrees relative to the U-type connector 245H. (That is, turns left at 135 degrees relative to the 245F.)

Figure 26:
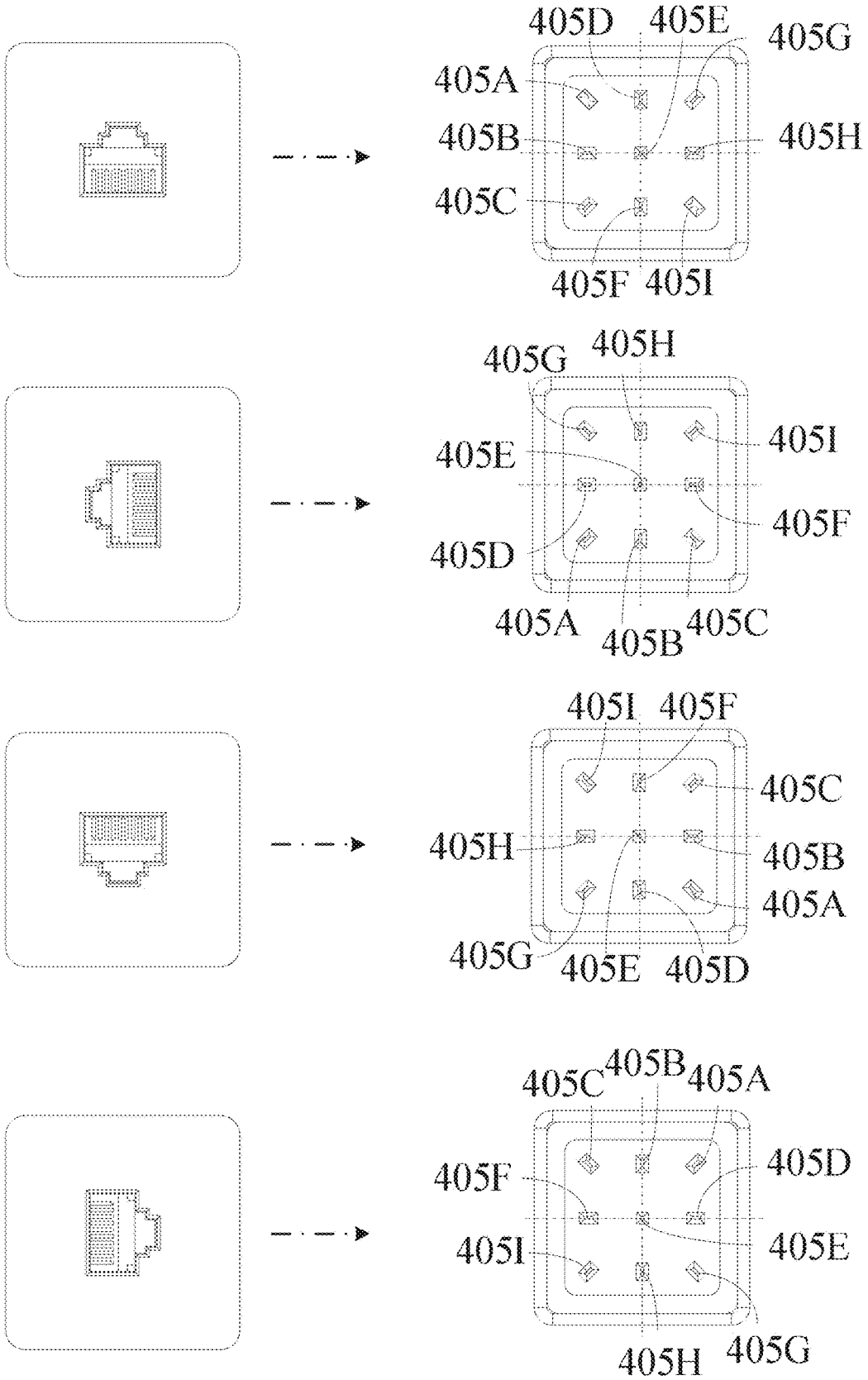
FIG. 26 illustrates the top view of the adapting interface of the ninth embodiment.

Please refer to FIG. 25 and FIG. 26. The adapting interface 40 includes 9 rectangular-column connectors 405A-405I corresponding to the U-type contacts 245A-245I in the ninth embodiment. The rectangular-column connectors are arranged in three lines as well. The rectangular-column connectors 405A-405C form the first line. The rectangular-column connectors 405D-405F form the second line. The rectangular-column connectors 405G-405I form the third line. The rectangular-column connectors 405D and 405F are arranged in the same direction. The rectangular-column connector 405E is a square-column connector in this embodiment to make the adapting interface 40 symmetric to both centerline and diagonal so that the sockets 34 and the adapters 20 are non-directional in the present disclosure. However, please refer to FIG. 26, any shapes which make the sockets 34 non-directional can be utilized in the rectangular-column connector 405E of the present disclosure, being a square-column is just one of the examples. The directions of the rectangular-column connectors 405A-405C arranged in the first line are required to correspond to the U-type contacts 245A-245C, therefore, the rectangular-column connector 405A turns left at 45 degrees relatively to the rectangular-column connectors 405D. The rectangular-column connectors 405B turns left at 45 degrees relative to the rectangular-column connectors 405A. (That is, turns left at 90 degrees relative to 405D.) The rectangular-column connectors 405C turns left at 45 degrees relative to the rectangular-column connectors 405B. (That is, turns left at 135 degrees relative to 405D.) Similarly, the directions of the rectangular-column connectors 405G-405I arranged in the third line are required to correspond to the U-type contacts 245G-245I, therefore, the rectangular-column connector 405G turns right at 45 degrees relative to the rectangular-column connectors 405D. The rectangular-column connectors 405H turns right at 45 degrees relative to the rectangular-column connectors 405G. (That is, turns right at 90 degrees relative to 405D.) The rectangular-column connectors 405I turns right at 45 degrees relative to the rectangular-column connectors 405H. (That is, turns right at 135 degrees relative to 405D.)

Figure 27:
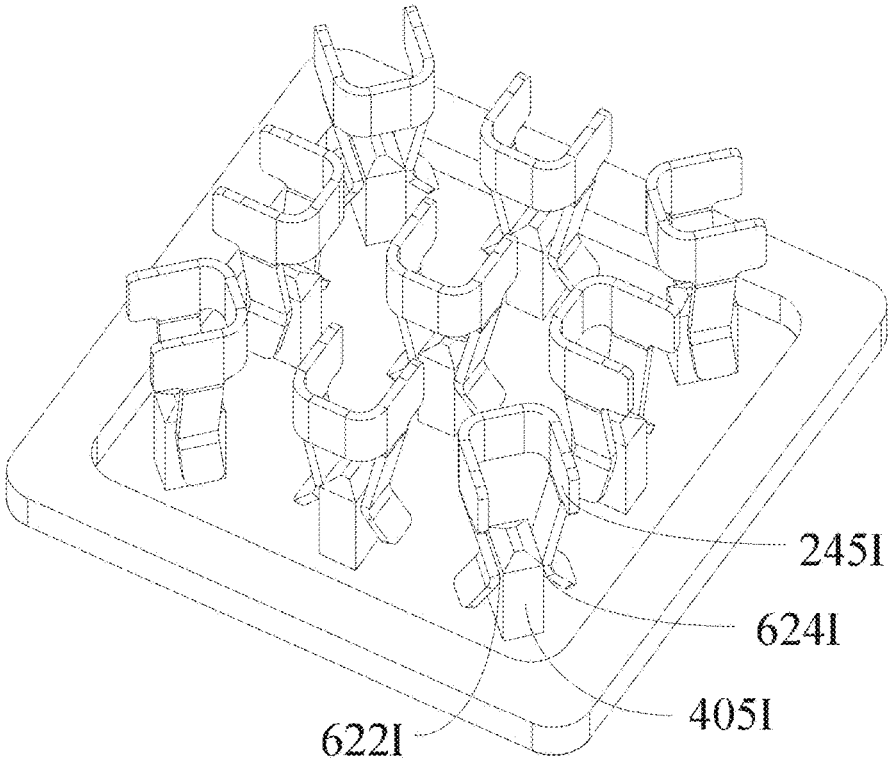
FIG. 27 illustrates the structure of the ninth embodiment in detail after the contacts and the adapting interface are connected to each other.

Please refer to FIG. 27 which illustrates the structure of the U-type contacts 245A-245I and the rectangular-column connectors 405A-405I after they are connected. Connecting the U-type contact 245A to the rectangular-column connector 405A, the U-type contact 245B to the rectangular-column connector 405B, the U-type contact 245C to the rectangular-column connector 405C in FIG. 25 can get the structures illustrated in the FIG. 27. Similar connections are made between the U-type contacts 245D-245I and the rectangular-column connectors 405D-405I respectively and will not be mentioned herein. The U-type contacts 245A-245I couple to the rectangular-column connectors 405A-405I. Take the U-type contact 245I and the rectangular-column connector 405I as an example, there are two contact points 622I and 624I between the U-type contact 245I and the rectangular-column connector 405I. The distance between 622I and 624I is narrower than dimension of the rectangular-column connector 405I. In the meanwhile, the U-type contact 245I is flexible, so that the contacts 24 will be stably connected to the adapting interface 40. In addition, since the directions of the U-type contacts are different, the adapter 20 will fasten onto the socket 34.

Figure 28:
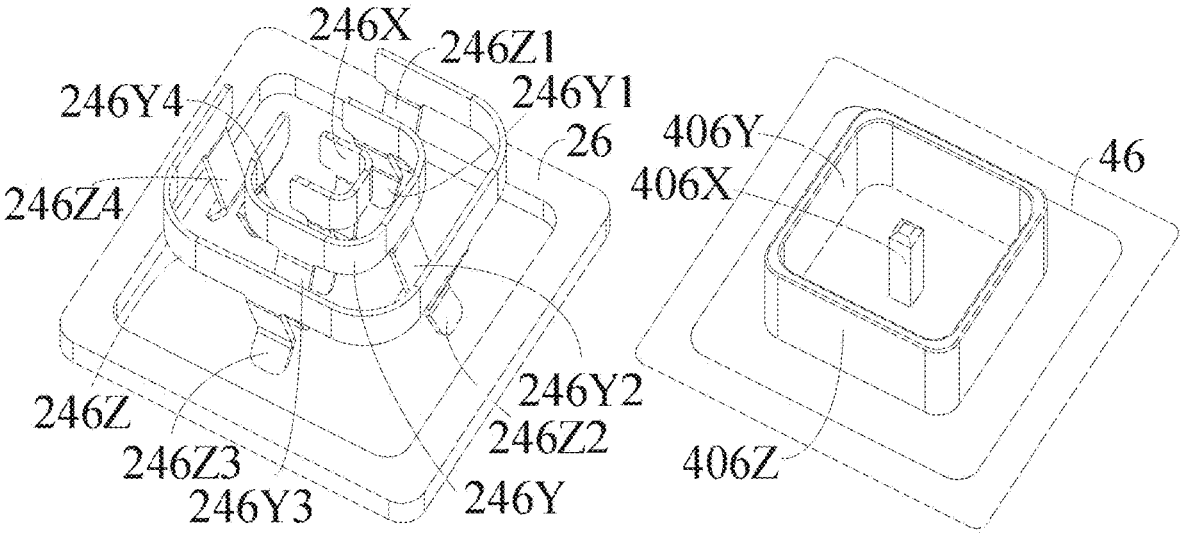
FIG. 28 illustrates the contacts and the adapting interface in detail of the tenth embodiment.

Please refer to FIG. 28. In the tenth embodiment, the contacts 24 consist of square contacts 246, and the adapting interface 40 includes the square connectors 406 corresponding to the square contacts 246. The square contacts 246 include three contact flakes 246X, 246Y, and 246Z. The structure of the contact flake 246X is similar to the U-type contacts. The contact flake 246Y surrounding the contact flake 246X, which is a square-circuit with opening or a closed square-circuit. The contact flake 246Y includes four contact pins 246Y1, 246Y2, 246Y3, and 246Y4. The shape of the contact flake 246Z is a square-circuit with opening or a closed square-circuit surrounding the contact flake 246Y. The contact flake 246Z also includes four contact pins 246Z1, 246Z2, 246Z3, and 246Z4. The square connectors 406 include a central pin 406X and two square ring 406Y and 406Z. The square ring 406Z surrounds the 406Y. The central pin 406X is located in the center of the square ring 406Y and 406Z.

Figure 29:
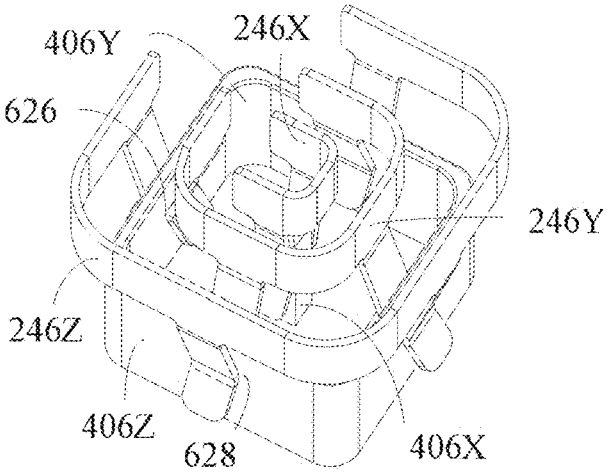
FIG. 29 illustrates the structure of the tenth embodiment in detail after the contacts and the adapting interface are connected to each other.

FIG. 29 illustrates the structures of the square contacts 246 and the square connectors 406 after they are connected to each other. The contact flake 246X couples to the central pin 406X. The contact flake 246Y couples to the square ring 406Y through the contact pins 246Y1, 246Y2, 246Y3, and 246Y4. Take the contact pin 246Y4 as an example, there is a contact point 626 between contact pin 246Y4 and the square ring 406Y. The contact pin 246Y4 can firmly couple to the square ring 406Y while the square contacts 246 connect to the square connectors 406 since the contact pin 246Y4 is flexible. Similarly, the contact pins 246Y1, 246Y2, and 246Y3 can also firmly contact with the square ring 406Y to make the contact flake 246Y couple to the square ring 406Y.

The contact flakes 246Z couple to the square ring 406Z through the contact pins 246Z1, 246Z3, 246Z3, and 246Z4 as well. Take the contact pin 246Z3 as an example, there is a contact point 628 between the contact pin 246Z3 and the square ring 406Z. The contact flakes 246Z couple to the square ring 406Z through the connection between the contact pins 246Z1, 246Z2, 246Z4, and the square ring 406Y as in the aforesaid illustration.

The contact flakes 246X, 246Y, and 246Z, and the central pin 406X, square ring 406Y, and 406Z can individually represent different potentials. For example, the contact flake 246X and the central pin 406X represent the earth (ground) lines, the contact flake 246Y and the square ring 406Y represent the live lines, and the contact flake 246Z and the square ring 406Z represent the neutral lines. By following the design of this embodiment, the power can be transmitted from the base 30 to the jack 22 after the adapters 20 are installed on the sockets 34.

Figure 30:
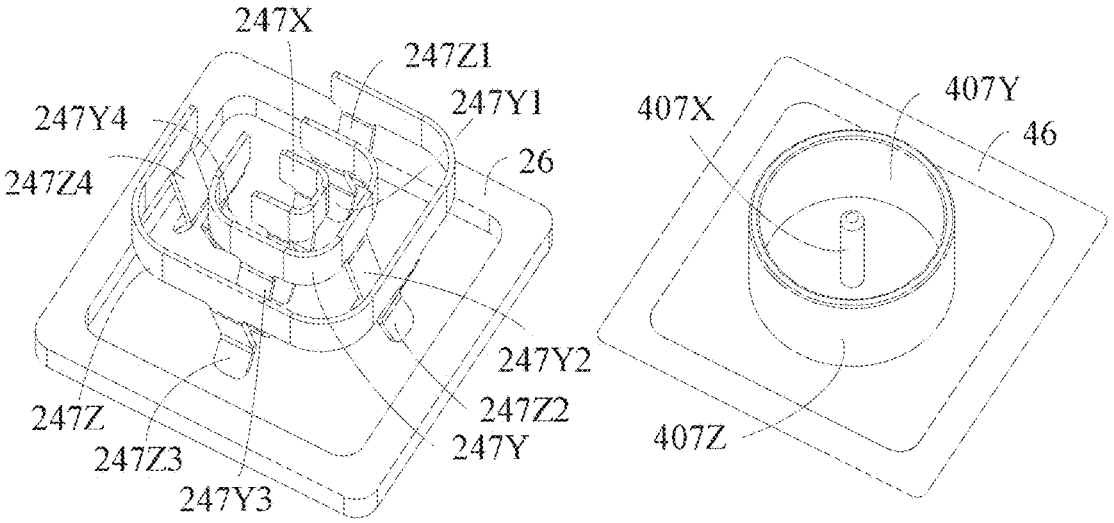
FIG. 30 illustrates the contacts and the adapting interface in detail of the eleventh embodiment.

FIG. 30 illustrates the eleventh embodiment that the contacts 24 consist of square contacts 247, and the adapting interface 40 includes circular connectors 407. The contacts 247 include three contact flakes 247X, 247Y, and 247Z. The shape of the contact flake 247X is similar to U-type contacts. The contact flake 247Y surrounding the contact flake 247X, which is a square-circuit with opening or a closed square-circuit. The contact flake 247Y includes four contact pins 247Y1, 247Y2, 247Y3, and 247Y4. The shape of the contact flake 247Z is a square-circuit with opening or a closed square-circuit surrounding the contact flake 247Z. The contact flake 247Z also includes four contact pins 247Z1, 247Z2, 247Z3, and 247Z4. The circular connectors 407 include a central pin 407X and two circular rings 407Y and 407Z. The circular ring 407Z surrounds the circular ring 407Y, and the central pin 407X locates at the center of the circular rings 407Y and 407Z.

Figure 31:
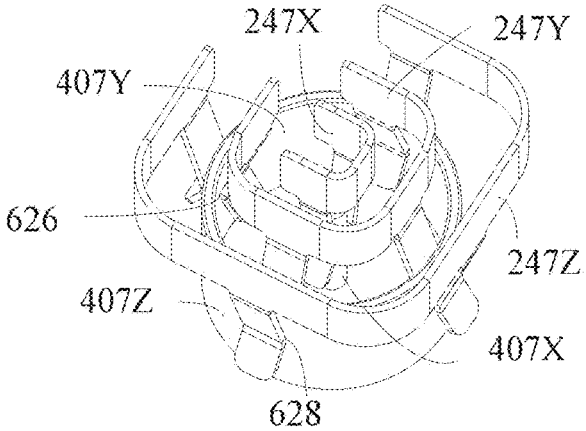
FIG. 31 illustrates the structure of the eleventh embodiment in detail after the contacts and the adapting interface are connected to each other.

FIG. 31 illustrates the structure of the square contacts 247 and the circular 407 after they are connected to each other. The contact flake 247X couples to the central pin 407X. The contact flake 247Y couples to the circular ring 407Y through the contact pins 247Y1, 247Y2, 247Y3, and 247Y4. Take the contact flake 247Y4 as an example, there is a contact point 626 between contact pin 247Y4 and the square ring 407Y. The contact pin 247Y4 can firmly couple to the square ring 407Y while the square contacts 24 connect to the square connectors 407 since the contact pin 247Y4 is flexible. Similarly, the contact pins 247Y1, 247Y2, and 247Y3 can also firmly contact with the square ring 407Y to make the contact flake 247Y couple to the square ring 407.

The contact flake 247Z couples to the circular ring 407Z through the contact pins 247Z1, 247Z2, 247Z3, and 247Z4. Take the contact pin 247Z3 as an example, there is a contact point 628 between the contact pin 247Z3 and the square ring 407Z. The contact flakes 247Z couple to the 407Z through the connection between the contact pins 247Z1, 247Z2, 247Z4 and the square ring 407Y as in the aforesaid illustration. This embodiment can transmit the power signals in different potentials as the tenth embodiment. In addition, this embodiment is non-directional so that the adapter 22 can be installed on the sockets 34 in any direction.

In the fifth to eleventh embodiments, the U-type contacts and the square contacts cannot exceed the horizontal line of the top plane of the socket 34 when they locate on the adapting interface 40. The cylindrical connectors, square-column connectors, rectangular-column connectors, square connectors and circular connectors cannot exceed the horizontal line of the top plane of the socket 34 when they locate on the adapting interface 40.

The adapters 20 of the first to eleventh embodiments can be designed as non-directional adapters, or be designed as directional adapters. For example, the U-type contacts could be designed in different directions that require corresponding connectors in specific directions and shapes to match with. Or the contacts 24 and the adapting interface 40 can only connect to each other in a specific direction because of their shapes. (Like rectangle can only fit in two ways.) Or the adapters 20 have a protrusion part which corresponds to the dent on the adapting interface 40, thus the adapters 20 can be installed on the socket 34 only when the outstanding parts match with the dents.

In addition, the base 30 further includes one or more switches. Please refer to FIG. 1, there is a vice-switches 320 disposed next to each socket to control the power through the sockets 34. The base can also have a switch 310 to control the power through the whole base 30. The switch 310 and the vice-switches 320 can include fuses to make the over-loaded base 30 or sockets 34 become open circuit.

The adapters 20 and the adapting interface 40 could further be designed to possess magnetism between the first magnetic part 26 and the second magnetic part 46 when the switch 310 or the vice-switches 320 are switched on. Hence the adapters 20 can be stably installed on the socket 34. In contrast, the magnetism between the first magnetic part 26 and the second magnetic part 46 will disappear when the switch 310 or the vice-switches 320 are switched off. In this case, the adapters 20 can be removed from the sockets 34.

The replaceable socket devices can further have a Power Line Communication (PLC) module which can process a data signal and allow the data signal to be transmitted via the power line. Thus the data signal can be transmitted between electronic devices, other PLC modules, the internet etc. The jack 22 could also be an RJ45 jack 226 or other jack for the internet, thus the replaceable socket devices of present disclosure can also supply data transmission while transmitting power.

The jack 22 can be an LED 228 so the adapter 20 can illuminate or show the condition of the sockets. For example, LED 228 can show the load of the replaceable socket devices by displaying different colors. Or the LED 228 can show the transmission condition of the replaceable socket devices by the different flashing frequency or different colors.

The replaceable socket devices of present disclosure solve the problems that the convention sockets cannot apply to different types of plugs through the structures of the adapters and the adapting interface. The replaceable socket devices can transmit not only power signals, but also data signals. The magnetic connection between the adapters and the sockets can improve the stability between them. And the replaceable socket devices of the present disclosure could be designed as directional or non-directional sockets. The separable interface allows the power cable to be separated from the base while the replaceable socket devices are not in use.

The present disclosure has been described with a preferred embodiment thereof and it is understood that many changes and modifications to the described embodiment can be carried out without departing from the scope and the spirit of the invention that is intended to be limited only by the appended claims.

What is claimed is:

1. A replaceable socket device comprising:

a plurality of adapters, each of the plurality of adapters comprising:

a jack, disposed on a top of the plurality of adapters, transmitting electrical signal to an external device; and a plurality of contacts, disposed on a bottom of the plurality of adapters;

a base, comprising a socket having a bottom surface and a sidewall to form only one opening, configured to allow one of the plurality of adapters to enter the socket via the opening, wherein the sidewall is connected to the bottom surface;

a plug, connected to an external power; and an adapting interface, disposed on the socket, and utilized to connect the socket and one of the plurality of adapters;

wherein the structure of the adapting interface corresponds to the plurality of contacts, for allowing one of the plurality of adapters to couple to the socket via the adapting interface, wherein a top of the adapting interface is lower than the bottom surface of the socket, and the sidewall of the socket surrounds at least a portion of the adaptor.

2. The replaceable socket device of claim 1, wherein the base further comprises a switch, controlling the power of the replaceable socket device to be on or off, where the switch can be on or off manually, or can be off automatically when over-loaded.

3. The replaceable socket device of claim 1, wherein the base further comprises a vice-switch, controlling the power of the one or more sockets to be on or off, where the vice-switch can be on or off manually, or can be off automatically when over-loaded.

4. The replaceable socket device of claim 1, wherein the jack is a 110-120V power jack, a 220-240V power jack, a USB jack, a RJ45 jack, or a 12V jack.

5. The replaceable socket device of claim 1, wherein the one or more adapters further comprise a first magnetic part, and the adapting interface further comprises a second magnetic part, where the first magnetic part and the second magnetic part connect to each other magnetically.

6. The replaceable socket device of claim 5, wherein the magnetism between the first magnetic part and the second magnetic part disappears when the power is off.

7. The replaceable socket device of claim 1, wherein the plurality of contacts are POGO PINs, U-type contacts, square contacts, or circular contacts.

8. The replaceable socket device of claim 7, wherein the adapting interface comprises a plurality of flat connectors, cylindrical connectors, square-column connectors, rectangular-column connectors, circular connectors, or square connectors, which correspond with and couple to the plurality of contacts.

9. The replaceable socket device of claim 7, wherein openings of U-type contacts are toward a same direction or arranged radially in 45 degrees relative to the center.

10. The replaceable socket device of claim 9, wherein the adapting interface comprises flat connectors, cylindrical connectors, square-column connectors, rectangular-column connectors, circular connectors, or square connectors, which correspond and couple to the shape and direction of the U-type contacts arranged radially.

11. The replaceable socket device of claim 1, wherein the adapting interface comprises POGO PIN, U-type contacts, square contacts, or circular contacts.

12. The replaceable socket device of claim 11, wherein the plurality of the contacts are flat connectors, cylindrical connectors, square-column connectors, rectangular-column connectors, circular connectors, or square connectors, which correspond with and couple to the adapting interface.

13. The replaceable socket device of claim 11, wherein the openings of U-type contacts located on the adapting interface are toward a same direction or arranged radially in 45 degrees relative to the center.

14. The replaceable socket device of claim 13, wherein the plurality of contacts are flat connectors, cylindrical connectors, square-column connectors, rectangular-column connectors, circular connectors, or square connectors, which correspond and couple to the shape and direction of the U-type contacts arranged radially.

15. The replaceable socket device of claim 1, wherein the plurality of contacts are grouped into two groups of a first potential and a second potential, or into three groups of the first potential, the second potential, and a third potential, which are arranged directionally or non-directionally.

16. The replaceable socket device of claim 1, wherein the adapting interface corresponding to the plurality of contacts is grouped into two groups of the first potential and the second potential, or into three groups of the first potential, the second potential, and the third potential, which are arranged directionally or non-directionally.

17. The replaceable socket device of claim 1, wherein the plurality of the contacts and the adapting interface comprise 8, 9, 12, or 16 contacting points.

18. The replaceable socket device of claim 1, wherein the one or more adapters is an LED for illuminating, appearing in different colors or different flashing frequencies.

19. The replaceable socket device of claim 1, wherein the plug is a separable plug which allows the plug separate from the base.

20. The replaceable socket device of claim 1, wherein the base is in a rectangular, circular, or triangular shape, where the one or more sockets are arranged in an array or circuit.

* * * * *